US007027754B2

(12) United States Patent
Harada et al.

(10) Patent No.: US 7,027,754 B2
(45) Date of Patent: Apr. 11, 2006

(54) PROCESS CARTRIDGE AND ELECTROPHOTOGRAPHIC IMAGE FORMING APPARATUS

(75) Inventors: Kinya Harada, Susono (JP); Kouji Hashimoto, Shizuoka-ken (JP); Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/337,891

(22) Filed: Jan. 8, 2003

(65) Prior Publication Data

US 2003/0142994 A1 Jul. 31, 2003

(30) Foreign Application Priority Data

Jan. 11, 2002 (JP) ..... 2002-004405

(51) Int. Cl.
*G03G 15/00* (2006.01)
*G03G 21/18* (2006.01)

(52) U.S. Cl. ..... 399/111; 399/113

(58) Field of Classification Search ..... 399/111, 399/113, 110, 75; 347/138, 152
See application file for complete search history.

(56) References Cited

U.S. PATENT DOCUMENTS

| | | | | |
|---|---|---|---|---|
| 5,740,500 | A | 4/1998 | Hashimoto | 399/114 |
| 5,878,309 | A | 3/1999 | Nomura et al. | 399/111 |
| 5,903,803 | A | 5/1999 | Kawai et al. | 399/116 |
| 5,907,751 | A * | 5/1999 | Kawaguchi et al. | 399/111 X |
| 5,923,924 | A | 7/1999 | Hashimoto | 399/111 |
| 5,940,657 | A | 8/1999 | Yokomori et al. | 399/119 |
| 5,943,528 | A | 8/1999 | Akutsu et al. | 399/110 |
| 5,946,531 | A | 8/1999 | Miura et al. | 399/111 |
| 5,950,049 | A | 9/1999 | Yokomori et al. | 399/119 |
| 5,953,562 | A | 9/1999 | Kawaguchi et al. | 399/117 |
| 6,016,408 | A | 1/2000 | Hashimoto et al. | 399/27 |
| 6,035,159 | A * | 3/2000 | Azuma et al. | 399/111 |
| 6,044,235 | A | 3/2000 | Hashimoto | 399/99 |
| 6,055,406 | A | 4/2000 | Kawai et al. | 399/360 |
| 6,061,538 | A | 5/2000 | Arimitsu et al. | 399/111 |
| 6,064,843 | A | 5/2000 | Isobe et al. | 399/111 |
| 6,072,969 | A | 6/2000 | Yokomori et al. | 399/119 |
| 6,101,352 | A | 8/2000 | Hashimoto et al. | 399/119 |
| 6,115,567 | A | 9/2000 | Kawai et al. | 399/106 |
| 6,128,452 | A | 10/2000 | Miyabe et al. | 399/90 |
| 6,128,454 | A | 10/2000 | Kawai et al. | 399/116 |
| 6,151,459 | A | 11/2000 | Hashimoto et al. | 399/27 |
| 6,163,665 | A | 12/2000 | Watanabe et al. | 399/111 |
| 6,175,706 | B1 | 1/2001 | Watanabe et al. | 399/167 |

(Continued)

FOREIGN PATENT DOCUMENTS

| | | | |
|---|---|---|---|
| EP | 833 227 A2 | | 4/1998 |
| JP | 06-194892 | * | 7/1994 |
| JP | 2000-056656 | * | 2/2000 |

*Primary Examiner*—Sophia S. Chen
(74) *Attorney, Agent, or Firm*—Fitzpatrick, Cella, Harper & Scinto

(57) ABSTRACT

A process cartridge detachably mountable to a main assembly of an electrophotographic image forming apparatus includes first and second end covers, first and second bottom-surface portions to be guided by first and second main assembly guide portions, first, second, and third portions to be positioned by first, second, and third main assembly positioning portions, and a driving force receiving portion partly exposed through the first end cover between the first and third portions to be positioned and engaging with a main assembly driving force transmitting portion to rotate a process-cartridge developing member when the process cartridge is mounted to the apparatus.

39 Claims, 8 Drawing Sheets

U.S. PATENT DOCUMENTS

| | | | | |
|---|---|---|---|---|
| 6,215,969 | B1 | 4/2001 | Nomura et al. | 399/111 |
| 6,226,478 | B1 | 5/2001 | Watanabe et al. | 399/117 |
| 6,240,266 | B1 | 5/2001 | Watanabe et al. | 399/117 |
| 6,246,853 | B1 | 6/2001 | Suzuki et al. | 399/262 |
| 6,282,390 | B1 | 8/2001 | Miyabe et al. | 399/111 |
| 6,324,357 | B1 | 11/2001 | Gomi et al. | 399/50 |
| 6,336,018 | B1 | 1/2002 | Kawai et al. | 399/117 |
| 6,351,620 | B1 | 2/2002 | Miyabe et al. | 399/111 |
| 6,381,430 | B1 | 4/2002 | Yokomori et al. | 399/119 |
| 6,459,869 | B1 | 10/2002 | Nittani et al. | 399/111 |
| 6,463,232 | B1 | 10/2002 | Kawai et al. | 399/111 |
| 6,463,234 | B1 | 10/2002 | Arimitsu et al. | 399/113 |
| 6,480,687 | B1 | 11/2002 | Kawai et al. | 399/111 |
| 6,496,667 | B1 | 12/2002 | Shiratori et al. | 399/103 |
| 6,501,926 | B1 | 12/2002 | Watanabe et al. | 399/117 |
| 6,501,927 | B1 | 12/2002 | Watanabe et al. | 399/117 |
| 6,505,021 | B1 | 1/2003 | Shibuya et al. | 399/149 |
| 2001/0022902 | A1 * | 9/2001 | Nittani et al. | 399/111 |
| 2002/0018668 | A1 | 2/2002 | Kanno et al. | 399/106 |
| 2002/0031368 | A1 | 3/2002 | Kanno et al. | 399/103 |
| 2002/0110388 | A1 | 8/2002 | Yokomori et al. | 399/167 |

* cited by examiner

COMPARATIVE EXAMPLE

PROCESS CARTRIDGE AND ELECTROPHOTOGRAPHIC IMAGE FORMING APPARATUS

FIELD OF THE INVENTION AND RELATED ART

The present invention relates to a process cartridge and an electrophotographic image forming apparatus employing a process cartridge.

Herein, an electrophotographic image forming apparatus is an apparatus which forms an image on a recording medium, with the use of an electrophotographic image forming method. It includes, for example, an electrophotographic copying machine, an electrophotographic printer (a laser beam printer, an LED printer, etc.), a facsimile machine, a word processor, etc.

A process cartridge is a cartridge in which at least an electrophotographic photoconductive member, and a developing means as a processing means, are integrally disposed to make them removably mountable in the main assembly of an image forming apparatus. A processing means includes a charging means, a cleaning means, etc., in addition to a processing means.

Conventionally, an electrophotographic image forming apparatus using an electrophotographic image forming process employs a process cartridge system, according to which an electrophotographic photoconductive member, and a single or plurality of processing means which act on the electrophotographic photographic member, are integrally disposed in a cartridge removably mountable in the main assembly of an image forming apparatus. A process cartridge system enables a user to maintain an image forming apparatus by him/her self, that is, without relying on service personnel, drastically improving operational efficiency. Thus, a process cartridge system has been widely used in the field of an electrophotographic image forming apparatus.

In an image forming apparatus, a beam of light modulated with image formation information is projected onto an electrophotographic member (which hereinafter will be referred to simply as a photoconductive drum) from a laser, an LED, a lamp, or the like. As a result, an electrostatic latent image is formed on the photoconductive drum. This electrostatic latent image is developed by a developing apparatus. Then, the image formed of developer, on the photoconductive drum, is transferred onto a recording medium; and as a result, an image is formed on recording medium.

In order for a process cartridge, employed by an image forming apparatus, such as the above-described ones, to form an electrostatic latent image with a high level of precision, it must be highly precisely positioned in the main assembly of an image forming apparatus, when it is mounted therein. Thus, mounting a process cartridge into the image forming apparatus main assembly, in the manner shown in FIG. 9, has been considered. That is, as a process cartridge is inserted into the main assembly of an image forming apparatus, first, it is positioned, relative to the main assembly, by first and second positioning points (a, b), which are the lengthwise end portions of the process cartridge, and the axial lines of which coincide with the axial line of the photoconductive drum. Then, it is positioned relative to the main assembly at the third positioning point (c'), which is off the axial line of the photoconductive drum. In other words, a process cartridge is positioned relative to the apparatus main assembly at three positioning points (a, b, and c'). The structural arrangement shown in FIG. 9 is one of the structural arrangements considered during the development of the present invention, and was not made public at the time of the filing of this specification.

Referring to FIG. 9, with the provision of the above-described structural arrangement, however, the point f of the developing apparatus, through which a driving force is inputted, is kept outside the area bordered by the three straight lines connecting the aforementioned three points (a, b, and c'), while a process cartridge is positioned relative to the apparatus main assembly by the three positioning points. When a process cartridge is supported in the apparatus main assembly, being positioned in the above described manner, the first and second positioning points a and b, which are at the lengthwise ends of the process cartridge, and which coincide with the axial line of the photoconductive drum, are subjected to such a force that acts in a direction to move the positioning points of the process cartridge away from their counterparts in the apparatus main assembly. In order to deal with this force, it has been necessary to take such measures as making the process cartridge more rigid around the positioning portions, increasing the force by which the positioning points are kept pressed upon the counterpart on the apparatus main assembly, and the like.

Also referring to FIG. 9, when the center of gravity of a process cartridge is outside the area bordered by the straight lines connecting the aforementioned three points, the aforementioned force which acts in the direction to move the three points away from their counterparts on the apparatus main assembly side is greater than otherwise.

Thus, in order to deal with this problem, it was necessary to take such measures as providing a process cartridge with additional components, reinforcing the positioning portions of the process cartridge, as well as the apparatus main assembly, and the like. These measures complicated the process cartridge and image forming apparatus, and this complication resulted in a cost increase. This complication and the resultant cost increase remain as the problems to be solved.

Thus, the present invention was made in consideration of the above described problems which the prior art failed to solve.

SUMMARY OF THE INVENTION

The primary object of the present invention is to provide a process cartridge ensured to be accurately positioned relative to the main assembly of an image forming apparatus, and an electrophotographic image forming apparatus in which such a process cartridge is removably mountable.

Another object of the present invention is to provide a process cartridge highly precisely positionable relative to the main assembly of an image forming apparatus, and an electrophotographic image forming apparatus in which such a process cartridge is removably mountable.

Another object of the present invention is to provide a process cartridge which is simple in structure, and yet, is accurately positionable relative to the main assembly of an image forming apparatus, and an electrophotographic image forming apparatus in which such a process cartridge is removably mountable.

Another object of the present invention is to provide a process cartridge which remains stable in attitude even while it is driven, and an electrophotographic image forming apparatus in which such a process cartridge is removably mountable.

Another object of the present invention is to provide a process cartridge comprising: an electrophotographic photoconductive drum; a developing member for developing an electrostatic latent image formed on the photoconductive drum; a first end cover located at one of the lengthwise ends of the photoconductive drum; a second end cover located at the other lengthwise end of the photoconductive drum; a first guide formed on the bottom surface of the process cartridge so that it is guided by a first guide of the main assembly of an image forming apparatus when the photoconductive drum is mounted into the apparatus main assembly; a second guide formed on the bottom surface of the process cartridge so that it is guided by a second guide of the apparatus main assembly when the photoconductive drum is mounted into the apparatus main assembly; a first positioning portion, which is positioned so that its axial line coincides with that of the photoconductive drum, and which projects outward of the process cartridge from the first end cover in the lengthwise direction of the photoconductive drum, and is fixed in position by a first positioning portion of the apparatus main assembly as the process cartridge is mounted into the apparatus main assembly, a second positioning portion, which is positioned so that its axial line coincides with that of the photoconductive drum, and which projects outward of the process cartridge from the second end cover in the lengthwise direction of the photoconductive drum, and is fixed in position by the second positioning portion of the apparatus main assembly as the process cartridge is mounted into the apparatus main assembly; a third positioning portion, which is disposed on the downstream side with respect to the first positioning portion in terms of the direction in which the process cartridge is mounted into the apparatus main assembly, and which projects outward of the process cartridge from the first end cover in the lengthwise direction of the photoconductive drum, and is fixed in position by a third positioning portion of the apparatus main assembly as the process cartridge is mounted into the apparatus main assembly; and a driving force receiving portion, which is disposed between the first positioning portion and third positioning portion in terms of the cartridge mounting direction, being partially exposed from the first end cover, and which engages with a driving force transmitting portion of the apparatus main assembly, from the upstream side in terms of the cartridge mounting direction, as the photoconductive drum is mounted into the apparatus main assembly, and receives from the driving force transmitting portion of the apparatus main assembly, the driving force for driving the developing member.

Another object of the present invention is to provide an electrophotographic image forming apparatus comprising: (a) first and second guides; (b) first, second, and third positioning portions; and (c) a cartridge mounting portion, in which a process cartridge is removable mountable. The process cartridge comprises: an electrophotographic photoconductive drum; a developing member for developing an electrostatic latent image formed on the photoconductive drum; a first end cover located at one of the lengthwise ends of the photoconductive drum; a second end cover located at the other lengthwise end of the photoconductive drum; a first guide formed on the bottom surface of the process cartridge so that it is guided by a first guide of the main assembly of an image forming apparatus when the photoconductive drum is mounted into the apparatus main assembly; a second guide formed on the bottom surface of the process cartridge so that it is guided by a second guide of the apparatus main assembly when the photoconductive drum is mounted into the apparatus main assembly; a first positioning portion, which is positioned so that its axial line coincides with that of the photoconductive drum, and which projects outward of the process cartridge from the first end cover in the lengthwise direction of the photoconductive drum, and is fixed in position by a first positioning portion of the apparatus main assembly as the process cartridge is mounted into the apparatus main assembly; a second positioning portion, which is positioned so that its axial line coincides with that of the photoconductive drum, and which projects outward of the process cartridge from the second end cover in the lengthwise direction of the photoconductive drum, and is fixed in position by the first positioning portion of the apparatus main assembly as the process cartridge is mounted into the apparatus main assembly; a third positioning portion, which is disposed on the downstream side with respect to the first positioning portion in terms of the direction in which the process cartridge is mounted into the apparatus main assembly, and which projects outward of the process cartridge from the first end cover in the lengthwise direction of the photoconductive drum, and is fixed in position by a third positioning portion of the apparatus main assembly as the process cartridge is mounted into the apparatus main assembly; and a driving force receiving portion, which is disposed between the first positioning portion and the third positioning portion in terms of the cartridge mounting direction, being partially exposed from the first end cover, and which engages with a driving force transmitting portion of the apparatus main assembly, from the upstream side in terms of the cartridge mounting direction, as the photoconductive drum is mounted into the apparatus main assembly, and receives from the driving force transmitting portion of the apparatus main assembly, the driving force for driving the developing member.

These and other objects, features, and advantages of the present invention will become more apparent upon consideration of the following description of the preferred embodiments of the present invention, taken in conjunction with the accompanying drawings.

DESCRIPTION OF THE PREFERRED EMBODIMENTS

Hereinafter, preferred embodiments of the present invention will be described with reference to the appended drawings.

Figure 1:
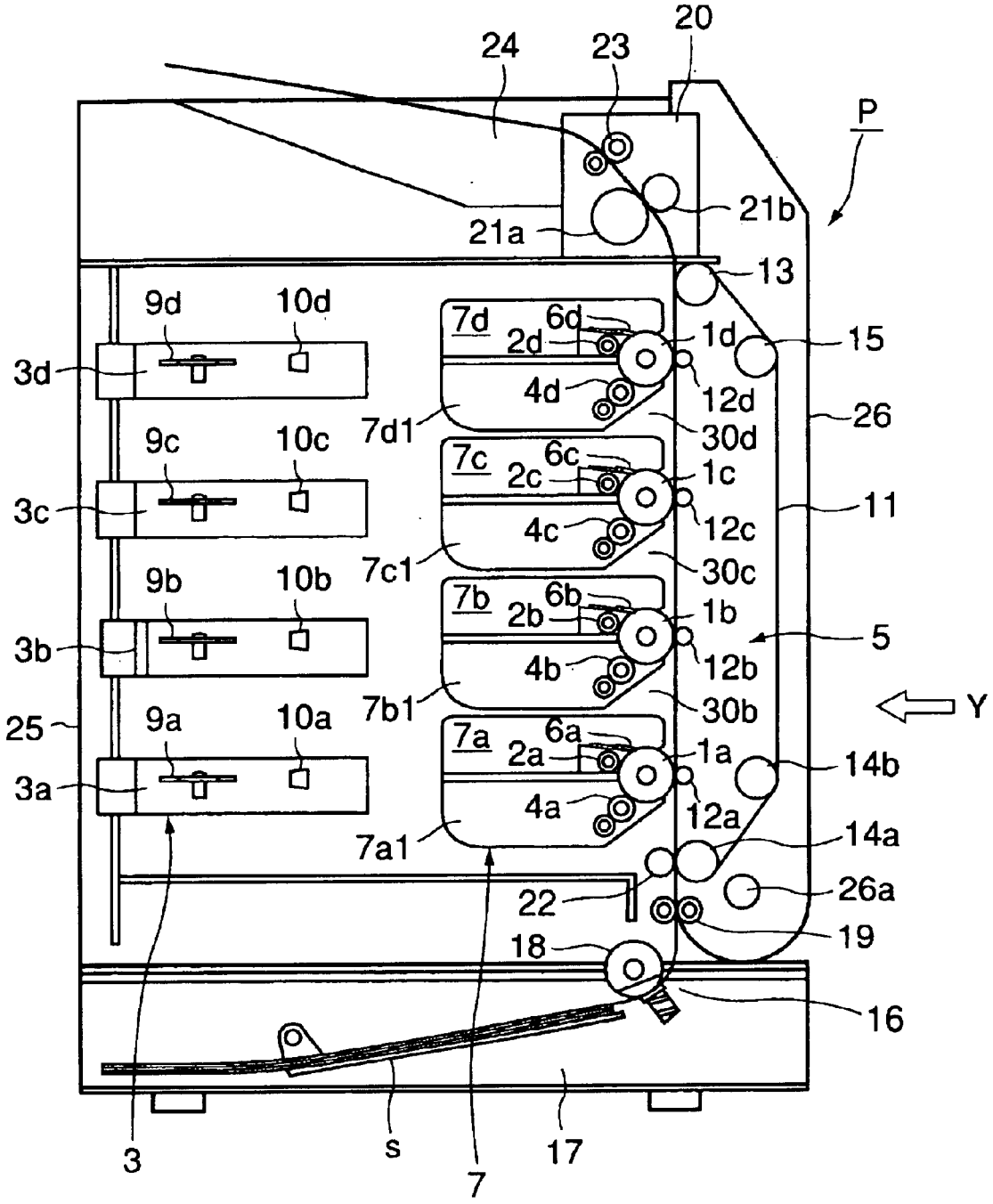
FIG. 1 is a vertical sectional view of an embodiment of an image forming apparatus in accordance with the present invention, in which a process cartridge in accordance with the present invention is removably mountable, for showing the general structure thereof.

First, referring to FIG. 1, the general structure and image forming process of an embodiment of an electrophotographic image forming apparatus in accordance with the present invention will be described. FIG. 1 is a vertical sectional view of a full-color laser beam printer, that is, an embodiment of an image forming apparatus in accordance with the present invention, for showing the general structure thereof.

The image forming apparatus P shown in FIG. 1 comprises a plurality (four in FIG. 1) of cartridge mounting portions into which a plurality of process cartridges or cassettes 7 (which hereinafter may be referred to simply as a cartridge) comprising a photoconductive drum are mounted, one for one. These cartridge mounting portions are vertically stacked in parallel. In each cartridge 7, the photoconductive drum (1*a*, 1*b*, 1*c*, and 1*d*) is rotationally driven by a driving means (unshown) in the counterclockwise direction. Around the peripheral surface of the photoconductive drum (1*a*, 1*b*, . . . ), a charging apparatus (2*a*, 2*b*, 2*c*, 2*d*) for uniformly charging the peripheral surface of the photoconductive drum (1*a*, 1*b*, . . . ), a scanner unit 3 (3*a*, 3*b*, 3*c*, 3*d*) for forming an electrostatic latent image on the peripheral surface of the photoconductive drum by projecting a beam of laser light modulated with image formation information, and a developing apparatus (4*a*, 4*b*, 4*c*, 4*d*) for adhering developer to the electrostatic latent image in order to develop the electrostatic latent image, are disposed in the mentioned order, in terms of the rotational direction of the photoconductive drum. Further, the full-color laser beam printer comprises an electrostatic transferring apparatus 5 for transferring a developer image on the photoconductive drum 1 onto a recording medium S. The electrostatic transferring apparatus 5 comprises an electrostatic transfer belt 11 and a transfer roller (12*a*, 12*b*, 12*c*, 12*d*). The full-color laser printer also comprises a cleaning apparatus (6*a*, 6*b*, 6*c*, 6*d*) for removing the developer remaining on the peripheral surface of the photoconductive drum after the image transfer therefrom.

Figure 4:
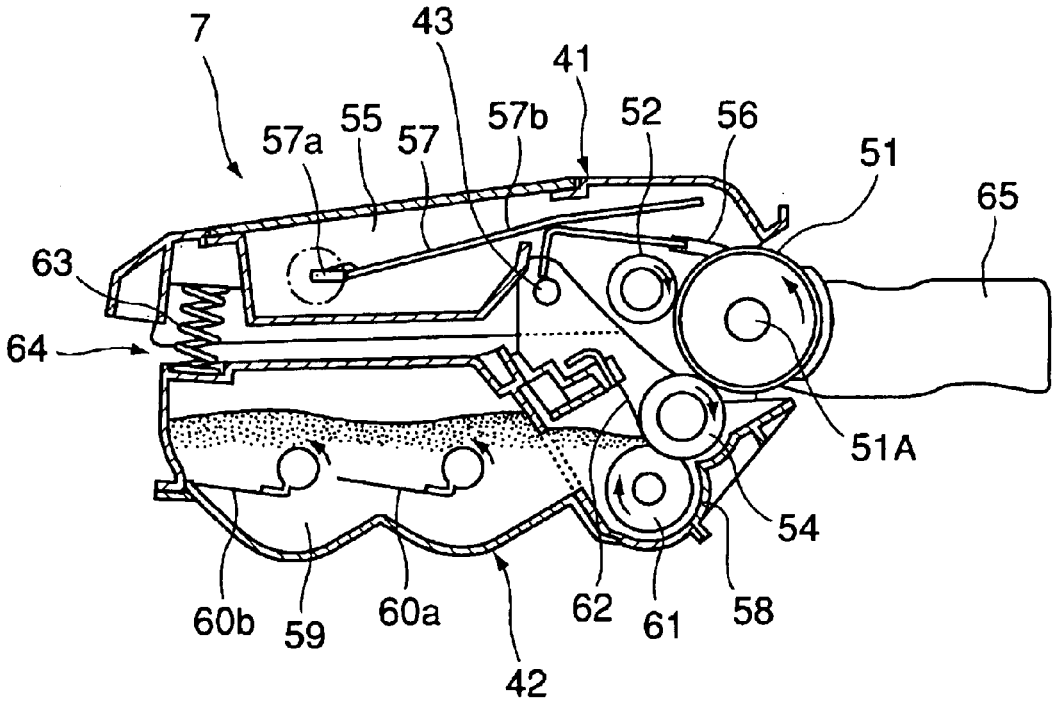
FIG. 4 is a schematic sectional view of the embodiment of a process cartridge in accordance with the present invention, for showing the general structure thereof.

The photoconductive drum (1*a*, 1*b*, . . . ), the charging apparatus 2 (2*a*, 2*b*, . . . ), the developing apparatus (4*a*, 4*b*, . . . ), the cleaning apparatus (6*a*, 6*b*, 6*c*, 6*d*), the developer storage portions (7*a*1, 7*b*1, 7*c*1, and 7*d*1), etc., are integrally disposed in the cartridge 7 (7*a*, 7*b*, 7*c*, 7*d*). The detailed structure of the cartridge 7 is shown in FIG. 4. Each cartridge 7 (7*a*, 7*b*, . . . ) is removably mounted in the corresponding cartridge mounting portion 30 (30*a*, 30*b*, 30*c*, 30*d*) of the main assembly 25 (which hereinafter will be referred to simply as an apparatus main assembly) of the full-color laser beam printer. The scanner unit 3 (3*a*, 3*b*, . . . ) is attached to the apparatus main assembly so that it opposes the cartridge 7 (7*a*, 7*b*, . . . ) when the cartridge 7 (7*a*, 7*b*, . . . ) is in the cartridge mounting portion 30 (30*a*, 30*b*, . . . ).

Next, the various components will be described regarding their structure, in a logical order. The cartridges 7*a*, 7*b*, 7*c*, and 7*d* are virtually identical in structure.

The photoconductive drums (1*a*, 1*b*, . . . ) comprise an aluminum cylinder, for example, with a diameter of 30 mm, and a layer of organic photoconductor coated on the peripheral surface of the aluminum cylinder. They are rotationally supported by a pair of bearings 66 and 67 (FIG. 5), by the lengthwise end portions of its drum shaft. To one of the lengthwise ends of the photoconductive drums, a driving force is transmitted from a motor (unshown) provided on the apparatus main assembly 25 side, as will be described later in more detail. As the driving force is transmitted, the photoconductive drums are rotationally driven in the counterclockwise direction of FIG. 1.

The charging apparatus (2*a*, 2*b*, . . . ) is of a type which employs a contact charging method. The charging apparatus has an electrically conductive roller, which is placed in contact with the peripheral surface of the photoconductive drums. The peripheral surface of the photoconductive drums are uniformly charged by applying charge bias, that is, a certain amount of voltage, is applied, with the charge roller being kept in contact with the peripheral surface of the photoconductive drums.

The scanner unit 3 (3*a*, 3*b*, . . . ) is horizontally disposed virtually in parallel to the photoconductive drums (1*a*, 1*b*, . . . ). The scanner unit 3 comprises a laser diode (unshown) which emits image formation light modulated with image formation signals; a scanner motor (unshown); a polygon mirror (9*a*, 9*b*, 9*c*, 9*d*) rotated by the scanner motor, and a focusing lens (10*a*, 10*b*, 10*c*, 10*d*). The image formation light emitted from the laser diode is projected toward the polygon mirror (9*a*, 9*b*, . . . ), being thereby deflected. The deflected image formation light is focused on the charged peripheral surface of the photoconductive drums (1*a*, 1*b*, . . . ), selectively exposing the numerous points of the peripheral surface of the photoconductive drums. As a result, an electrostatic latent image, different in a corresponding primary color component from those formed in the other process cartridges, is formed on each photoconductive drum.

The developing apparatuses 4*a*, 4*b*, 4*c*, and 4*d* have developer storage portions holding yellow, magenta, cyan, and black developers, respectively. Each developing apparatus develops an electrostatic latent image formed on the corresponding photoconductive drum (1*a*, 1*b*, . . . ), into an image formed of the developer, by adhering the developer contained therein to the electrostatic latent image. In the developer storage portion 7*a*1 of the cartridge 7*a*, developer with the yellow color is stored. Similarly, in the developer storage portions 7*b*1, 7*c*1, and 7*d*1 of the cartridges 7*b*, 7*c*, and 7*d*, respectively, developers with magenta, cyan, and black colors, are stored, respectively.

The cleaning apparatus (6*a*, 6*b*, 6*c*, and 6*d*) is for removing (scraping down) the developer remaining on the peripheral surface of the photoconductive drum (1*a*, 1*b*, . . . ) after the developer image formed on the peripheral surface of the photoconductive drum (1*a*, 1*b*, . . . ) is transferred onto the recording medium s by the electrostatic transferring apparatus 5. The cleaning of the photoconductive drum(1*a*, 1*b*, . . . ) by the cleaning apparatus makes the photoconductive drum ready for the next rotation for an image formation process.

The electrostatic transferring apparatus 5 is provided with an electrostatic transfer belt 11 for conveying the recording medium s while electrostatically holding the recording medium s so that the recording medium s comes into contact with each of the plurality of the photoconductive drums (1*a*, 1*b*, . . . ), one by one. The electrostatic transferring apparatus 5 is also provided with a plurality of transfer rollers 12*a*, 12*b*, 12*c*, and 12*d* disposed in a manner to oppose the photoconductive drums 1*a*, 1*b*, 1*c*, and 1*d*, respectively, in order to sequentially transfer the developer images formed on the photoconductive drums 1*a*, 1*b*, 1*c*, and 1*d*, respectively, onto the recording medium s.

The transfer belt 11 is formed of film, the volume resistivity of which is in the range of $10^{11}$–$10^{14}$ Ω.cm. It circularly moves, remaining in contact with all of the photoconductive drums (1*a*, 1*b*, . . . ). The transfer belt 11 in this embodiment is approximately 700 mm in circumference, and approximately 150 μm in thickness. It is suspended by a pair of follower rollers 14*a* and 14*b*, a tension roller 15, and a driver roller 13, also called the driving roller 13, and is circularly driven by the force from the driver roller 13 (in the arrow direction in FIG. 1). Disposed in a manner to oppose the follower roller 14*a*, that is, the follower roller on the bottom side, is an electrostatic adhesion roller 22, which is kept pressed on the outward surface of the transfer belt 11, being enabled to nip the recording medium s between itself and the transfer belt 11. As voltage is applied to between the transfer belt 11 and adhesion roller 22, electrical charge is induced between the recording medium s, which is a dielectric, and the dielectric layer of the transfer belt 11, keeping thereby the recording medium s electrostatically adhered to the outward surface of the transfer belt 11.

Each transfer roller (12*a*, 12*b*, . . . ) is disposed at a position at which it opposes the corresponding photoconductive drum (1*a*, 1*b*, . . . ), and is in contact with the inward surface of the transfer belt 11. As positive electric charge is applied to the recording medium s through the transfer belt 11, a developer image on the photoconductive drum, which is negative in polarity, is transferred by the electric field generated by the positive electric charge given to the recording medium s, onto the recording medium s in contact with the photoconductive drum.

The transfer belt 11 of the transferring apparatus 5 structured as described above adheres, in cooperation with the adhesion roller 22, the recording medium s to the outward surface of the transfer belt 11, on the left side of the circulative loop of the transfer belt 11, of the transferring apparatus, in FIG. 1, and circularly moves in a manner to place the recording medium s in contact with each of the photoconductive drums (1*a*, 1*b*, . . . ). While the recording medium s is conveyed from the roller 14*a* side to the roller 13 side, the developer image on each of the photoconductive drums (1*a*, 1*b*, . . . ) is transferred onto the recording medium s by the function of the transfer rollers (12*a*, 12*b*, . . . ) opposing the photoconductive drums (1*a*, 1*b*, . . . ), respectively.

A conveying portion 16 is a portion for conveying the recording medium s to the image forming portion. It comprises: a cassette 17, a conveying roller 18, and a registration roller pair 19. The cassette 17 holds a plurality of recording media s. During an image forming operation, the conveying roller 18 and the registration roller pair 19 are rotationally driven in synchronism with the developer image formation, whereby the plurality of the recording media s in the cassette 17 are sequentially conveyed into the image forming portion while being separated one by one. As the leading edge of each recording medium s comes into contact with the registration roller pair 19 while the registration roller pair 19 is not in motion, the recording medium s is temporarily stopped, being forced to temporarily curve. Then, the registration roller pair 19 is rotated to release the recording medium s onto the transfer belt 11 so that the arrival of the transfer starting line of the recording medium s at the nipping portion between the photoconductive drum and transfer roller synchronizes with the arrival of the leading edge of the developer image on the photoconductive drum at the nipping portion.

A fixing portion 20 is for fixing a plurality of unfixed developer images, different in color, on the recording medium s, to the recording medium s. It comprises a rotational heat roller 21*a*, and a pressure roller 21*b* kept pressed upon the heat roller 21*a* to apply heat and pressure to the recording medium s. More specifically, while the recording medium s, onto which the plurality of developer images different in color have been transferred from the plurality of the photoconductive drums, one for one, is conveyed through the fixing portion 20, by the fixing roller pair (21*a* and 21*b*), heat and pressure are applied by the fixing roller pair. As a result, the plurality of the developer images different in color are fixed to the surface of the recording medium s.

Next, the image forming process carried out by this embodiment of the image forming apparatus in accordance with the present invention will be described. After being mounted in the cartridge mounting portions 30 (30*a*, 30*b*, . . . ) (FIGS. 1, 2, and 3) of the apparatus main assembly 25, the process cartridges 7 (7*a*, 7*b*, are sequentially driven in synchronism with the developer image formation timing. As they are driven, the photoconductive drums (1*a*, 1*b*, . . . ) are rotationally driven in the counterclockwise direction, and the scanner units 3 (3*a*, 3*b*, . . . ) opposing the cartridges 7 (7*a*, 7*b*, . . . ) one for one are sequentially driven.

Further, as the process cartridges 7 (7*a*, 7*b*, . . . ) are driven, the charging apparatus (2*a*, 2*b*, . . . ) uniformly charge the peripheral surface of the corresponding photoconductive drum, and the uniformly charged peripheral surface of the photoconductive drum (1*a*, 1*b*, . . . ) is exposed to the light projected by the unit 3 (3*a*, 3*b*, . . . ) while being modulated with image formation signals. As a result, an electrostatic latent image corresponding to a specific primary color component is formed on the peripheral surface of one of the photoconductive drums (1*a*, 1*b*, . . . ). The development roller in the developing apparatus (4*a*, 4*b*, . . . ) supplies the developer in one of the developer storage portions (7*a*1, 7*b*1, . . . ) of one of the cartridges 7 (7*a*, 7*b*, . . . ), to the developing portion, in which the developer is transferred onto the points of the peripheral surface of one of the photoconductive drums, which is lower in potential level. As a result, a visible image is formed of the developer, on the peripheral surface of one of the photoconductive drums (1*a*, 1*b*, . . . ); in other words, the electrostatic latent image on one of the photoconductive drums (1*a*, 1*b*, . . . ) is developed.

Meanwhile, the rotation of the registration roller pair 19 is started to release the recording medium s onto the transfer belt 11 so that the arrival of the leading edge of the developer image on the peripheral surface of the photoconductive drum 1*a*, that is, the most upstream photoconductive drum in terms of the recording medium conveyance direction, at a predetermined line in the nipping portion between the transfer belt 11 and one of the transfer rollers (12*a*, 12*b*, 12*c*, 12*d*), synchronizes with the arrival of the transfer starting line of the recording medium s at the predetermined line in the nipping portion.

As the recording medium s is conveyed by the transfer belt 11, it is pressed onto the outward surface of the transfer belt 11 by the adhesion roller 22, and voltage is applied between the transfer belt 11 and adhesion roller 22, ensuring that while the recording medium s is conveyed from the most upstream transfer station to the most downstream transfer station, it remains electrostatically adhered to the outward surface of the transfer belt 11.

As described above, the recording medium s is conveyed by the transfer belt 11. While the recording medium s is conveyed, the developer images, corresponding one for one to the primary color components, on the photoconductive drum 1*a*, the photoconductive drum 1*b*, the photoconductive drum 1*c*, and the photoconductive drum 1*d* are sequentially transferred onto the recording medium s by the electrical fields generated between the photoconductive drums (1*a*, 1*b*, . . . ) and transfer rollers (12*a*, 12*b*, . . . ), respectively.

After the transfer of the developer images different in color onto the recording medium s, the recording medium s is separated from the transfer belt with the utilization of the curvature of the belt driving roller 13, and is conveyed into the fixing portion 20, in which the developer images are thermally fixed to the recording medium s by the heat roller 21*a* and pressure roller 21*b*. Thereafter, the recording medium s is discharged from the apparatus main assembly 25 through the outlet 24, by a discharge roller pair 23.

Meanwhile, the photoconductive drums (1*a*, 1*b*, . . . ) are cleaned by the cleaning apparatus (6*a*, 6*b*, . . . ); the residual developer, that is, the developer remaining on the peripheral surface of the photoconductive drums (1*a*, 1*b*, . . . ), is scraped down by the cleaning apparatus (6*a*, 6*b*, . . . ). The cleaned portion of the peripheral surface of the photoconductive drums is usable for the following image forming process.

Next, the structure of the cartridge mounting portion of the apparatus main assembly, the structure of a process cartridge removably mountable in the apparatus main assembly, and the method for removably mounting the process cartridge in the apparatus main assembly, will be described.

In consideration of the durability of the processing members, that is, the photoconductive drum, the charging device, the developing apparatus, the cleaning apparatus, etc., and the amount of the developer storable in the developer storage portion, the process cartridge 7 is structured so that it can be replaced with a new one as its cumulative usage reaches a predetermined amount. When the process cartridge 7 must be removed from the apparatus main assembly due to the expiration of one or a plurality of its processing members, or the depletion of the developer therein, or when a new process cartridge (7) is mounted into the apparatus main assembly, the cartridge 7 is moved, relative to the cartridge mounting portion 30 of the apparatus main assembly 25, in the direction perpendicular to the axial line of the photoconductive drum 1.

Figure 2:
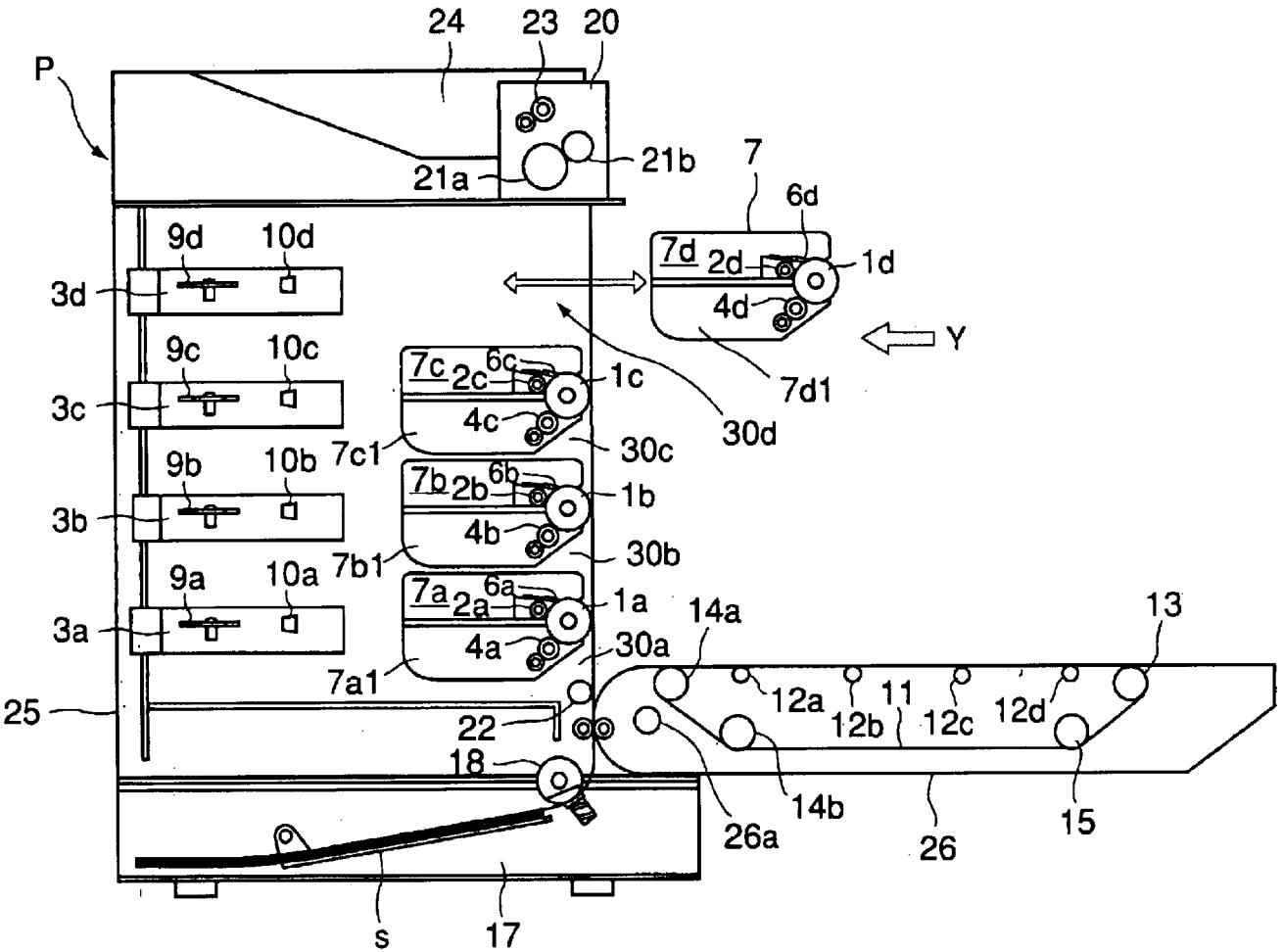
FIG. 2 is a vertical sectional view of an embodiment of an image forming apparatus in accordance with the present invention, in which a process cartridge in accordance with the present invention is removably mountable, and the front door of which is open.
Figure 3:
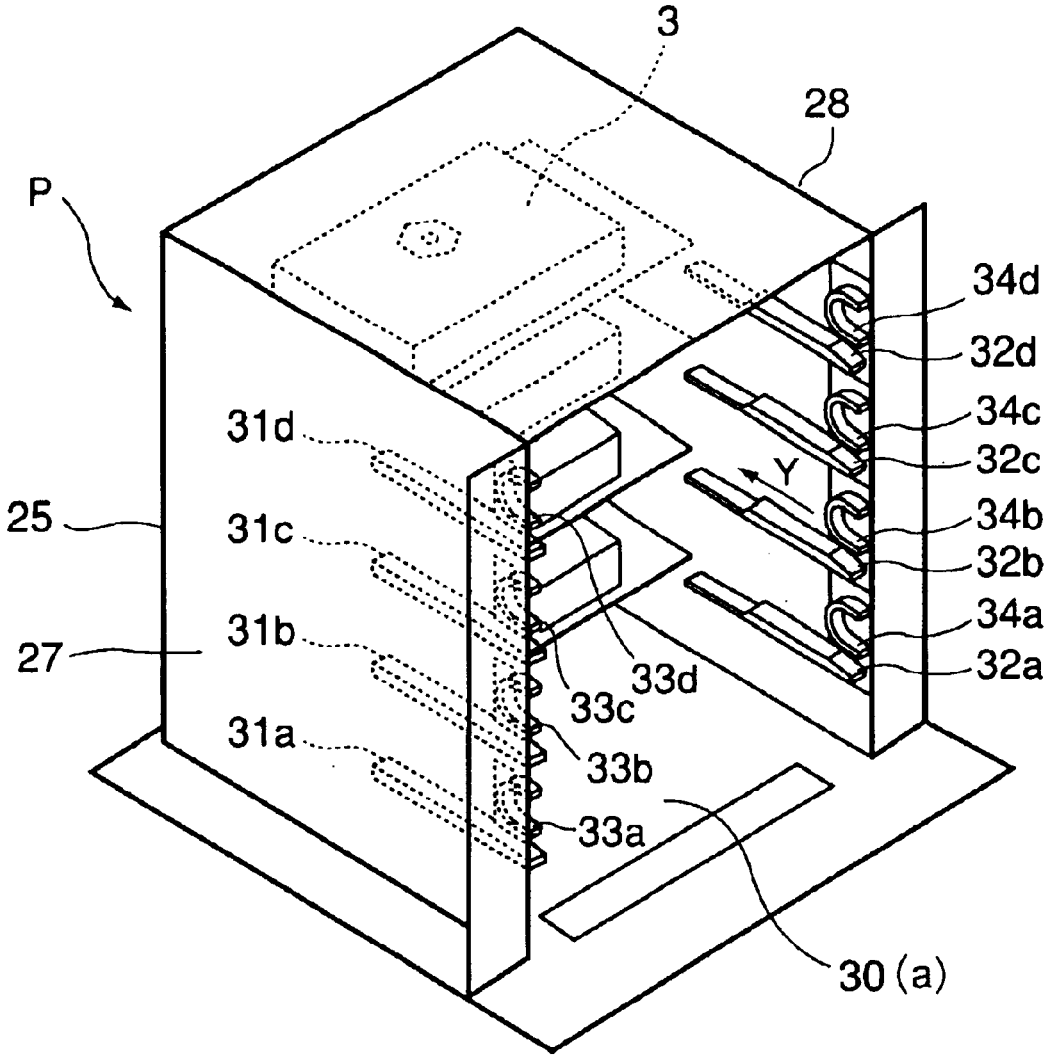
FIG. 3 is a schematic perspective view of the cartridge mounting portion of the embodiment of an image forming apparatus in accordance with the present invention, in which a process cartridge in accordance with the present invention is removably mountable.

Referring to FIGS. 2 and 3, the apparatus main assembly 25 is provided with a cartridge entrance (opening) wider than the length of the cartridge 7 (the dimension of the cartridge 7 in terms of lengthwise direction of the photoconductive drum). It is also provided with a plurality (four in drawings) of cartridge mounting portions 30 (30*a*, 30*b*, 30*c*, 30*d*). This cartridge entrance is provided with a front door 26, which is attached to the apparatus main assembly 25 so that it can be opened or closed by being rotated about a shaft 26*a*. To the front door 26, the transfer belt 1, transfer rollers (12*a*, 12*b*, . . . ), transfer belt support rollers 13, 14*a*, 14*b*, 15, etc., of the transferring apparatus 5 are attached. Normally, the front door 26 is kept closed, as shown in FIG. 1, and is opened by an operator when mounting a process cartridge (7) for the first time, or replacing the process cartridge 7 with a new one (FIG. 2). As the front door 26 is opened, the transferring apparatus 5 is moved with the front door 26, exposing the cartridge mounting portions 30.

Referring to FIG. 3, a first side wall 27 of the apparatus main assembly 25 is provided with a plurality (four in FIG. 4) of first guides 31 (31*a*, 31*b*, 31*c*, 31*d*) for guiding the cartridges 7 into the cartridge mounting portions 30, and a second wall 28 of the apparatus main assembly 25 is provided with second guides 32 (32*a*, 32*b*, 32*c*, 32*d*) for guiding the cartridges 7 into the cartridge mounting portions 30. The first guides 31 (31*a*, 31*b*, . . . ) are placed parallel to each other, at equal intervals, and also, the second guides 32 (32*a*, 32*b*, . . . ) are placed parallel to each other, at equal intervals. Designated by reference numerals 33 (33*a*, 33*b*, 33*c*, 33*d*) and 34 (34*a*, 34*b*, 34*c*, 34*d*) are first and second positioning portions for positioning the cartridges 7, and their details will be described later. Each cartridge mounting portion 30 is provided with an elastic member (unshown), for example, a holding spring, for applying pressure upon the cartridge 7 to hold the cartridge 7 at a predetermined position. The elastic member may be of a type which presses on the top surface of the frame of the process cartridge 7 in the direction in which the process cartridge is mounted into the apparatus main assembly 25, or a type which presses the positioning potions of the process cartridge upon the counterparts of the apparatus main assembly 25.

As for the cartridge 7 (7*a*, 7*b*, . . . ), referring to FIG. 4, the frame of the cartridge 7 is provided with a pair of handles 65, which are located at the ends of the cartridge frame in terms of its widthwise direction (the lengthwise direction of the photoconductive drum), and which project in a direction opposite to the cartridge mounting direction. When the cartridge 7 is mounted into the cartridge mounting portion 30 of the apparatus main assembly 25, the pair of handles 65 are grasped by the hands of an operator so that the process cartridge 7 can be horizontally inserted into the cartridge mounting portion 30, following the guides 31 and 32 (FIG. 3) on the first and second side walls 27 and 28, respectively, of the apparatus main assembly 25, with the photoconductive drum being on the front side of the apparatus main assembly 25. Using this cartridge mounting method, each cartridge 7 is mounted into the corresponding cartridge mounting portion 30 of the apparatus main assembly 25. After the mounting of the cartridge 7 into the cartridge mounting portion 30 of the apparatus main assembly 25, the front door 26 is closed. As the front door 26 is closed, the process cartridges 7 are made to settle into predetermined positions by the pressure from the elastic members (unshown), that is, the pressing springs, and at the same time, the transfer belt 11 of the transferring apparatus 5 comes into contact with the photoconductive drum of each cartridge 7.

Next, the structures of the cartridge 7 and the apparatus main assembly 25, which are essential for precisely positioning the cartridge 7 relative to the apparatus main assembly 25 when mounting the cartridge 7 into the apparatus main assembly 25, will be described.

Figure 5:
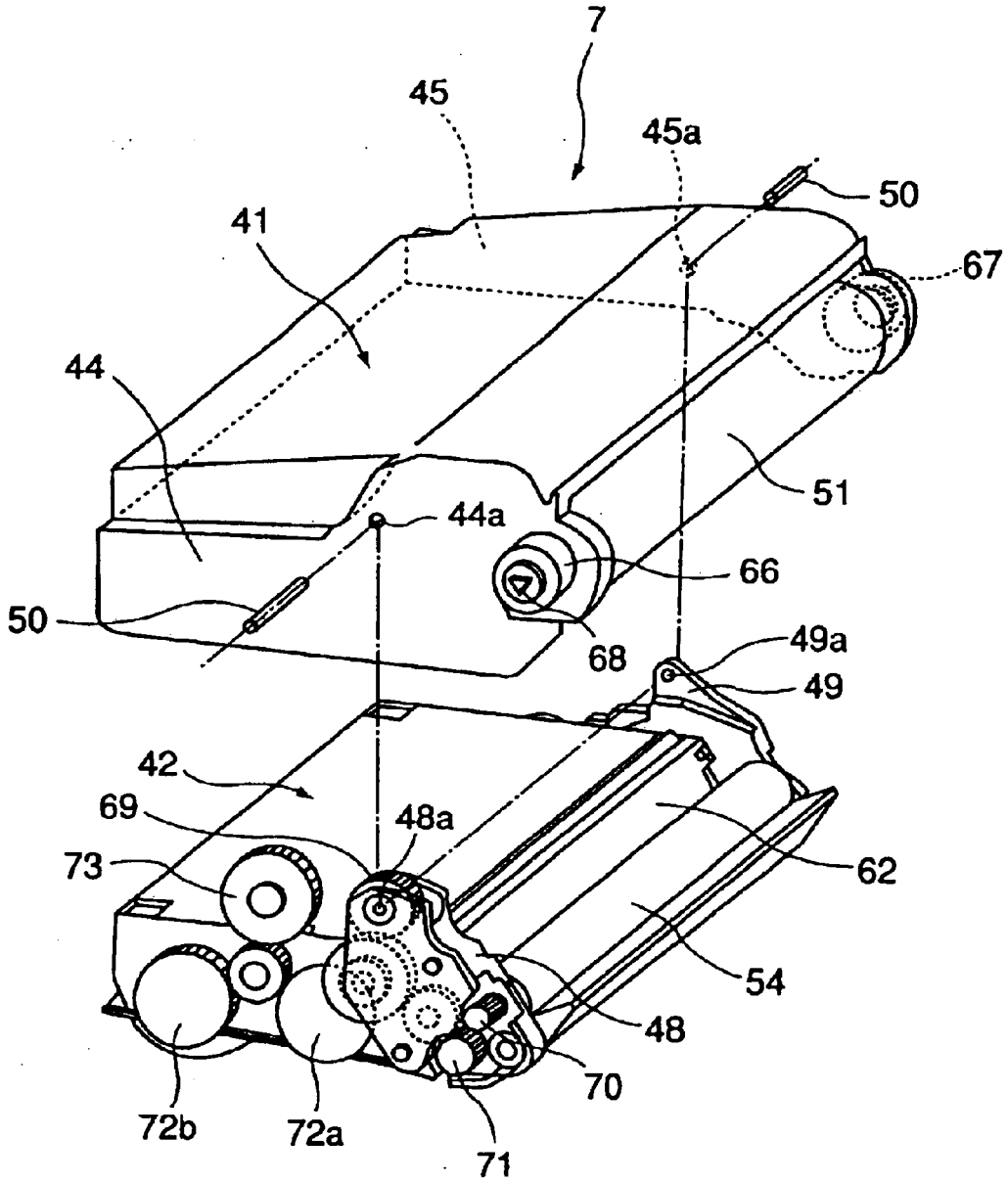
FIG. 5 is an exploded schematic perspective view of the embodiment of a process cartridge in accordance with the present invention.

Referring to FIGS. 4 and 5, this embodiment of a process cartridge in accordance with the present invention comprises a drum unit 41 as the top unit, and a development unit 42 as the bottom unit. The two units 41 and 42 are connected to each other so that they can be pivoted about a pair of pivots 43 as will be described later.

Referring to FIG. 5, the drum unit 41 is provided with a first end cover 44 and a second end cover 45, which are located at the lengthwise ends of the drum unit 41, one for one. The first and second end covers 44 and 45 are provided with holes 44*a* and 45*a* for connecting the drum unit 41 to the development unit 42. The holes 44*a* and 45*a* correspond in position to the pivots 43, respectively. The photoconductive drum 51 (corresponding to photoconductive drum in FIG. 1) is rotationally supported by the first and second end covers 44 and 45 of the drum unit 41; the drum shaft 51A of the photoconductive drum 51 is rotationally supported by a pair of bearings 66 and 67 attached to the first and second end covers 44 and 45, respectively. Further, the drum unit 41 comprises: the charging member 52 (charge roller) of the charging apparatus; a cleaning member 56 (cleaning blade 56) of the cleaning apparatus; a removed developer storage portion 55 for storing the developer removed by the blade 56; and a removed developer conveying means 57. The conveying means 57 comprises: a crank 57*a* rotationally disposed in the removed developer storage portion 55; and a removed developer conveying member 57*b* attached, like a connecting rod, to the crank pin portion of the crank. Thus, as the crank 57*a* rotates, the conveying member 57*b* is made to reciprocate, conveying the removed developer from the adjacencies of the blade 56 to the removed developer storage portion 55.

The development unit 42 comprises: a developing member 54 (development roller) of the developing apparatus; a developing means holding frame 58; and a developer storage portion 59 (which corresponds to developer storage portions 7*a*1, 7*b*1, 7*c*1, and 7*d*1 in FIGS. 1 and 2) for storing a developer different in color from the developers in the other cartridges. The developer storage portion 59 is located under the removed developer storage portion 55, and is provided with a pair of stirring members 60*a* and 60*b*, which are disposed within the developer storage portion 55 and double as a developer conveying mechanism. The developer within the developer storage portion 59 is conveyed, while being stirred, by the pair of stirring members 60*a* and 60*b* to the developer supply roller 61 in the developing means holding frame 58. Then, the developer is adhered to the peripheral surface of the development roller 54, by the developer supply roller 61, and the development blade 62 kept pressed upon the peripheral surface of the development roller 54, while being given electric charge.

Referring to FIG. 5, the side walls (end walls in terms of the lengthwise direction of development roller 54) of the development unit 42 are provided with a pair of extensions 48 and 49, one for one, for connecting the development unit 42 with the drum unit 41. The extensions 48 and 49 are provided with through holes 48*a* and 49*a*, respectively, the axial lines of which correspond with the axial lines of the pivots 43. Through these through holes 48*a* and 49*a*, and the holes 44*a* and 45*a* of the drum unit 41, a pair of positioning pins 50 (pivots 43) are inserted, one for one, from outward of the cassette 17, so that the drum unit 41 and the development unit 42 are connected to each other, being enabled to pivot about the positioning pins 50, as shown in FIG. 4.

Further, a pair of pressing springs 63 are disposed between the units 41 and 42, which are also called elastic members, at the left and right corners of the leading end portions of the two unit, in terms of the cartridge inserting direction. Therefore, the development roller 54 is kept pressed upon the peripheral surface of the photoconductive drum while being allowed to orbitally move about the positioning pins 50 (pivots 43), ensuring that the photoconductive drum 51 and the development roller 54 are kept in contact with each other across their lengthwise ranges. Referring to FIG. 4, reference numeral 64 stands for an exposure opening, which is provided between the drum unit 41 and development unit 42, and through which an optical image is projected from the scanner unit 3 onto the photoconductive drum 51 to form a latent image on the photoconductive drum 51.

Next, the mechanism for transmitting a driving force to the cartridge 7 will be described. In this embodiment, the force for driving the cartridge 7 is transmitted from the apparatus main assembly 25 directly to both the drum unit 41 and the development unit 42 of the cartridge 7.

Referring to FIG. 5, the photoconductive drum 51 is rotationally supported by the first and second end covers 44 and 45 of the drum unit 41, with the interposition of the pair of bearings 66 and 67, respectively. Further, the photoconductive drum 51 is provided with a coupling 68, as a member for the photoconductive drum. 51 to receive the driving force from the apparatus main assembly 25, which is attached to one end of the drum shaft 51A, whereas the apparatus main assembly 25 is provided with a coupling (unshown) as a member for transmitting the driving force from the apparatus main assembly 25 to the photoconductive drum 51. With the provision of this structural arrangement, the force for driving the photoconductive drum 51 is transmitted from the apparatus main assembly 25 to the photoconductive drum 51. The coupling 68 on the cartridge side (which hereinafter will be referred to as the cartridge coupling) is in the form of a twisted column, the cross section of which is in the form of an approximately equilateral triangle, whereas the coupling on the apparatus main assembly side (which hereinafter will be referred to as the main assembly coupling) is a member with a hole in the form of a twisted column, the cross section of which is in the form of an approximately equilateral triangle. The main assembly coupling engages with the cartridge coupling 68 in a direction parallel to the lengthwise direction of the photoconductive drum 51. As the main assembly coupling begins to be rotated, the cartridge coupling 68 is gradually drawn into the main assembly coupling due to the twist of the cartridge coupling 68, and the twist of the hole of the main assembly coupling, and fully engages with the cartridge coupling 68 by the time it is rotated 120°. In other words, the driving force is transmitted to the photoconductive drum 51 through the cartridge coupling 68.

The development unit 42 is provided with a gear 69, as a member (f) for receiving the force for driving the development roller 54, which is attached to the extension 48 of the development unit 42, that is, the extension on the side from which the process cartridge 7 is driven. The gear 69 is a helical gear. The gear 69 is also called a development roller driving force receiving portion or member and is also called a driving force receiving portion. To the gear 69, a driving force is transmitted from a helical gear 69*c* (FIG. 6), as a member, on the apparatus main assembly side, for transmitting the force for driving the development roller 54 (which hereinafter may be referred to as the driving force transmitting main assembly member). The gear 69*c* is also called a development roller driving force transmitting member and is also called a driving force transmitting portion. The gear 69 is disposed at the same lengthwise end of the cartridge 7 as the cartridge coupling 68. In terms of the direction in which the cartridge 7 is mounted into the apparatus main assembly 25, the gear 69 is disposed on the downstream side with respect to the cartridge coupling 68, and in terms of the direction perpendicular to the cartridge mounting direction, the gear 69 is disposed on the inward side with respect to the cartridge coupling 68.

The axial line of the gear 69 coincides with the axial line of the through hole 48*a*, the axial line of which coincides with the axial line of each of the pivots 43. Thus, the axial line of the gear 69 coincides with the axial line of each of the positioning pins 50 (pivots 43) connecting the drum unit 41 and developing unit 42. The gear 69 is partially exposed at the gear exposure opening of the first end cover 44 of the drum unit 41, and meshes, by the portion exposed from the gear exposure opening, with the helical gear 69*c*, as the development roller driving force transmitting member on the apparatus main assembly side. In terms of the direction in which the cartridge 7 is mounted, the gear 69*c* with which the gear 69 meshes is disposed on the downstream side with respect to the center of the gear 69, being attached to the apparatus main assembly 25.

The driving force transmitted to the gear 69 as the development roller driving force receiving member is transmitted to the development roller 54, stirring members 60*a* and 60*b*, as well as the removed developer conveying means 55 of the drum unit 41, in a bifurcating manner, through a gear train. More specifically, the driving force received by the gear 69 is transmitted to a development roller gear 70 attached to the lengthwise end of the development roller 54, and a gear 71 attached to the lengthwise end of the developer supply roller 61, through idler gears, rotating the development roller 54 and the developer supply roller 61, respectively. The idler gears are configured so that they function as a driving speed reducing means. They are meshed with the developer stirring gears 72*a* and 72*b* of the stirring members 60*a* and 60*b*, respectively. Therefore, the stirring members 60*a* and 60*b* are rotated by the driving force transmitted, in a bifurcating manner, through the idler gears. The idler gears are also connected, through an idler gear 73, to a gear (unshown) attached to the crank 57*a* of the removed developer conveying means 57 of the drum unit 41, transmitting thereby the driving force to the crank 57*a* and the removed developer conveying member 57*b*. In other words, after being inputted into the aforementioned gear 69 of the development unit 42, the driving force drives the development roller 54, the stirring members 60*a* and 60*b*, etc., in the development unit 42. Further, it drives the removed developer conveying means 57 in the drum unit 41.

Next, the structure for ensuring that the cartridge 7 is precisely positioned relative to the apparatus main assembly 25 will be described.

Figure 7:
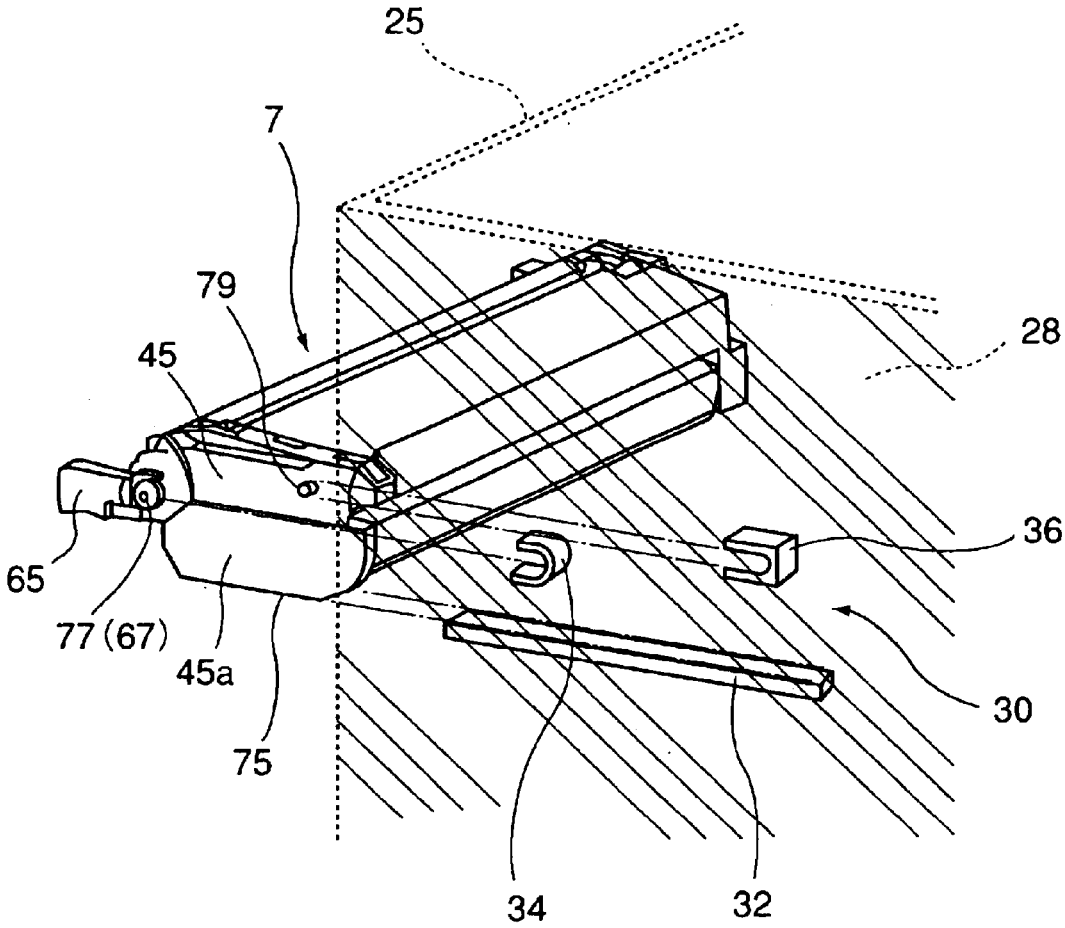
FIG. 7 is a schematic perspective view of the embodiment of a process cartridge in accordance with the present invention, as seen from the diagonally right direction in terms of the direction in which the process cartridge is inserted into the main assembly of an image forming apparatus in accordance with the present invention, for showing how the process cartridge is positioned relative to the apparatus main assembly.

The first and second end covers 44 and 45 of the cartridge 7 are disposed at the lengthwise ends of the cartridge 7, one for one, so that they become parallel to the first and second side walls 27 and 28, respectively, of the apparatus main assembly 25, when the cartridge 7 is properly mounted in the apparatus main assembly 25 (FIGS. 3, 5, and 7). The first and second side walls 27 and 28 of the apparatus main assembly 25 are provided with the first and second sets of guides, respectively, for guiding the cartridge 7 into the cartridge mounting portion 30 when the cartridge 7 is mounted into the apparatus main assembly 25. The cartridge 7 is provided with the first and second guides 74 and 75, which are at the lengthwise ends, one for one, of the bottom surface, and which are guided by one of the first set of guides 33, and the corresponding guide of the second set of guides 34, of the apparatus main assembly 25, respectively. The first guide 74 of the cartridge 7 is a part of the bottom portion of the first end cover 44 (that is, side wall of the top unit 41) of the cartridge 7, and the second guide 75 of the cartridge 7 is a part of the bottom portion 45*a* of the second end cover 45, that is, the bottom portion of the side wall of the bottom unit 42.

Therefore, when the cartridge 7 is mounted into the cartridge mounting portion 30 of the apparatus main assembly 25, the first guide 74 of the cartridge 7 is guided by the first guide 31 of the first side wall 27 of the apparatus main assembly 25, and the second guide 75 of the cartridge 7 is guided by the second guide 32 of the second side wall 28 of the apparatus main assembly 25.

Figure 6:
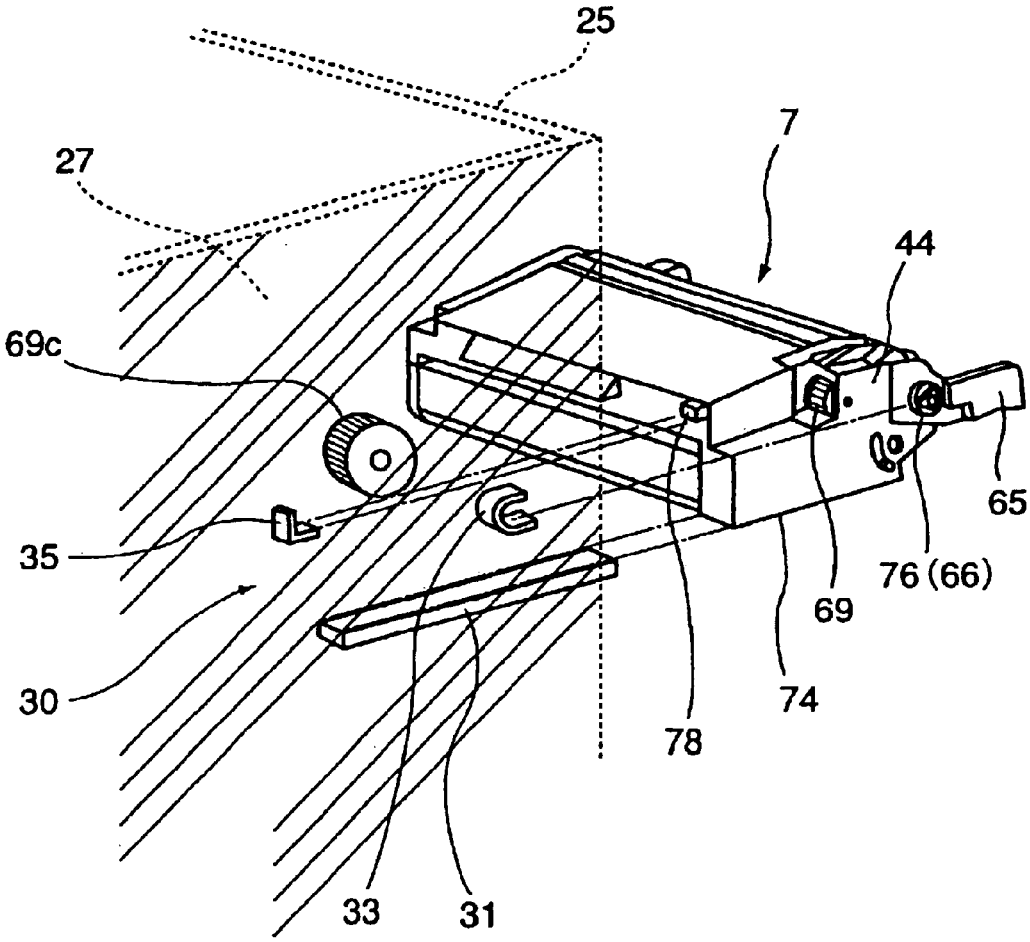
FIG. 6 is a schematic perspective view of the embodiment of a process cartridge in accordance with the present invention, as seen from the diagonally left direction in terms of the direction in which the process cartridge is inserted into the main assembly of an image forming apparatus in accordance with the present invention, for showing how the process cartridge is positioned relative to the apparatus main assembly.

Referring to FIGS. 6 and 7, in order to position the cartridge 7 relative to the cartridge mounting portion 30, the cartridge mounting portion 30 is provided with a first positioning portion 33, a second positioning portion 34, and a third positioning portion 35, whereas the cartridge 7 is provided with a first positioning portion 76, a second positioning portion 77, and a third positioning portion 78.

The first positioning portion 76 of the cartridge 7 is positioned so that its axial line coincides with that of the photoconductive drum 51 in the cartridge 7. It projects outward from the first end cover 44 of the cartridge 7 in the lengthwise direction of the photoconductive drum 51. The second positioning portion 77 of the cartridge 7 is similar to the first positioning portion 76 of the cartridge 7. That is, its axial line coincides with that of the photoconductive drum 51 in the cartridge 7. It projects outward from the second end cover 45 of the cartridge 7 in the lengthwise direction of the photoconductive drum 51. In this embodiment, the bearings 66 and 67 of the first and second end covers 44 and 45 are utilized as the first and second positioning portions 76 and 77, respectively. In other words, the dimension of the cartridge 7 is reduced by making the portions for rotationally supporting the photoconductive drum 51 double as the portions for positioning the cartridge 7. The bearings 66 and 67 are attached to the end covers 44 and 45, respectively, and rotationally support the drum shaft 51A of the photoconductive drum 51. The first and second positioning portions 76 and 77 of the cartridge 7 are positioned by the first and second positioning portions 33 and 34 of the apparatus main assembly 25, respectively, as the cartridge 7 is mounted into the cartridge mounting portion 30 of the apparatus main assembly 25. The first and second positioning portions 33 and 34 of the apparatus main assembly 25 are attached to the first and second side walls 27 and 28 of the apparatus main assembly 25.

Positioning of the first and second positioning portions 76 and 77 by the counterparts on the apparatus main assembly 25 side, alone, cannot prevent the cartridge 7 from being rotated by the moment generated as the driving force is transmitted to the development roller 54 (developing member) from the apparatus main assembly 25 to rotate the development roller 54. Therefore, in order to deal with this problem, the cartridge 7 is provided with the cylindrical third positioning portion 78, which is on the downstream side with respect to the first positioning portion 76, in terms of the cartridge mounting direction Y (FIGS. 1, 2 and 3), and which projects from the first end cover 44 in the direction parallel to the lengthwise direction of the cartridge 7. Correspondingly, the apparatus main assembly 25 is provided with the third positioning portion 35, which is attached to the first side wall 27 to catch the third positioning portion 78. The third positioning portion 78 of the cartridge 7 is desired to be cylindrical, and also, is desired to be molded as an integral part of the first end cover 44 formed of a resinous substance. More specifically, it is desired that the first end cover 44 is provided with a recess, from the bottom surface of which the third positioning portion 78 projects, and that the top end of the third positioning portion 78 is level with, or recessed from, the top edges of the lateral walls of the recess. In terms of the cartridge mounting direction Y, the development roller driving force receiving portion 69, which is a helical gear, is disposed between the third and first positioning portion 78 and 76, being partially exposed from the first end cover 44 (FIG. 6). Further, the third positioning portion 78 is disposed at a level below the path which the development roller driving force receiving portion 69 follows when the development roller driving force receiving portion 69 is moved in the cartridge mounting direction Y to be engaged with the development roller driving force transmitting member 69*c* of the apparatus main assembly 25. Further, the developer roller driving force receiving portion 69 in the form of a helical gear, the cylindrical third positioning portion 78 of the cartridge 7, and the first positioning portion 76 of the cartridge 7, which doubles as the bearing 66 for rotationally supporting the drum shaft 51A of the photoconductive drum 51, are disposed in the mentioned order, listing from the inward to outward direction in terms of the lengthwise direction of the cartridge 7 (FIG. 6).

Further, referring to FIG. 7, the cartridge 7 is provided with the third guide 79, in addition to the first and second guides 74 and 75, as the guide for guiding the cartridge 7 during the mounting of the cartridge 7. The third guide 79 is disposed on the downstream side with respect to the second positioning portion 77 in terms of the cartridge mounting direction Y. In terms of the vertical direction, the third guide 79 is disposed at a level higher than the third positioning portion 78. It projects outward from the second end cover 45 of the cartridge 7 in the lengthwise direction of the photoconductive drum 51. It is a cylindrical member formed of a resinous substance, and is molded as an integral part of the resinous second end cover 45. Further, it is guided by a third guide 36 of the apparatus main assembly 25 when the cartridge 7 is mounted into the apparatus main assembly 25.

Figure 8:
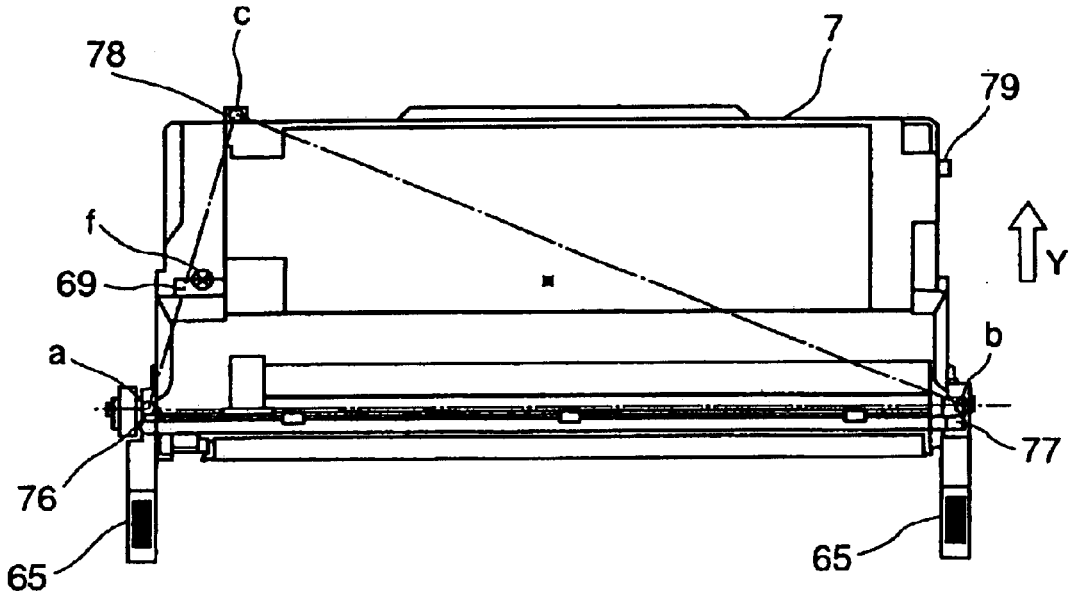
FIG. 8 is a top plan view of the embodiment of a process cartridge in accordance with the present invention, for showing how the process cartridge is supported in an image forming apparatus in accordance with the present invention.
Figure 9:
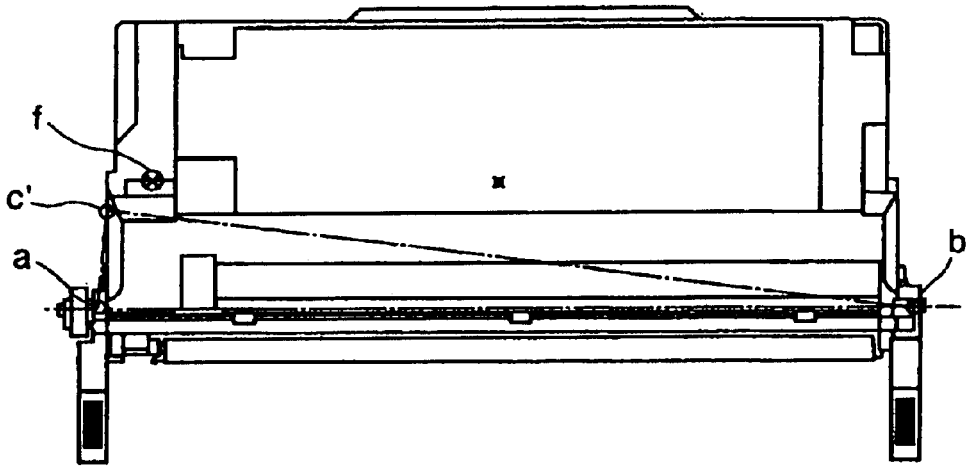
FIG. 9 is a top plan view of a comparative example of a process cartridge, for showing how the process cartridge is supported in an image forming apparatus in accordance with the prior art.

Referring to FIGS. 6 and 7, with the provision of the above described structural arrangement, not only is the cartridge 7 supported by the first, second, and third positioning portions 76, 77, and 78, but also it is positioned by them, in the cartridge mounting portion 30 of the apparatus main assembly 25. In other words, the position of the cartridge 7 relative to the cartridge mounting portion 30 is fixed by three points (a, b, and c) as shown in FIG. 8. Also in FIG. 8, the points a and b are the contact points between the bearings 66 and 67 as the first and second positioning portions 76 and 77 of the cartridge 7, and the first and second positioning portions 33 and 34 of the apparatus main assembly 25, respectively. In this embodiment, they coincide, one for one, with the intersection of the axial line of the drum shaft 51A of the photoconductive drum 51, and the plane which halves the bearing 66 in terms of its widthwise direction, and the intersection of the axial line of the drum shaft 51A of the photoconductive drum 51, and the plane which halves the bearing 67 in terms of its widthwise direction. The point c is the contact point between the third positioning portion 78 projecting from the cartridge 7 and the third positioning portion 35 of the apparatus main assembly 25. In this embodiment, it coincides with the center of the intersection of the plane which halves the third positioning portion 78 in terms of its projecting direction, and the plane which halves the third positioning portion 78 in terms of the direction perpendicular to its projecting direction. The point f coincides with the intersection of the addendum circle (FIG. 8) of the gear 69 (development roller driving force receiving portion), and the plane which halves the gear 69 in terms of its width direction. Further, in this embodiment, the points a, b, and c have only to be the contact points between the first, second, and third positioning portions 76 (66), 77 (67), and 78 of the cartridge 7, and the first, second, and third positioning portions 33, 34, and 35 of the apparatus main assembly 25, respectively, and they do not need to coincide with the above described specific points. Therefore, the development roller driving force receiving point (f) falls within the triangular area bordered by the lines connecting the three points (a, b, and c), as shown in FIG. 8. With the provision of this structural arrangement, the cartridge 7 is kept stable in attitude even while the cartridge 7 is driven. Further, the cartridge 7 is positioned with a high degree of reliability and precision, while employing the simple structural arrangement. Further, the loads which act on the first and second positioning portions 76(*a*) and 77(*b*) can be substantially reduced or virtually eliminated. Further, in this embodiment, the center of gravity (g) of the cartridge 7 also falls within the above described triangular area, as does the developer roller driving force receiving point (f), enhancing the above described effects of the present invention.

Further, in this embodiment, the third positioning portion 78 of the cartridge 7 is positioned on the downstream side with respect to the first positioning portion 76 of the cartridge 7 in terms of the cartridge mounting direction, and is in the form of a cylindrical column projecting outward from the first end cover 44 of the cartridge 7 in the lengthwise direction of the cartridge 7. Therefore, the cartridge 7 is precisely positioned, and is kept stable in attitude, with the use of the simple structural arrangement. Further, it is possible to reduce the sizes of the apparatus main assembly 25 and cartridge 7.

The above described embodiment can be summarized as follows.

The process cartridge 7, that is, the first embodiment of a process cartridge in accordance with the present invention, which is removably mountable in the main assembly 25 of an electrophotographic image forming apparatus, is characterized in that it comprises: the electrophotographic photoconductive drum 51 (1); a developing member 54 for developing an electrostatic latent image formed on the photoconductive drum 51; a first end cover 44 disposed at one of the lengthwise ends of the photoconductive drum 51; a second end cover 45 disposed at the other lengthwise end of the photoconductive drum 51; a first guide 74 formed on the bottom surface of the cartridge 7 so that it is guided by the first guide 31 of the apparatus main assembly 25 when the cartridge 7 is mounted into the apparatus main assembly 25; a second guide 75 formed on the bottom surface of the cartridge 7 so that it is guided by the second guide 32 of the apparatus main assembly 25 when the cartridge 7 is mounted into the apparatus main assembly 25; a first positioning portion 76, which is positioned so that its axial line coincides with that of the photoconductive drum 51, and which projects outward from the first end cover 44 of the cartridge 7 in the lengthwise direction of the photoconductive drum 51, and is fixed in position by the first positioning portion 33 of the apparatus main assembly 25 as the cartridge 7 is mounted into the apparatus main assembly 25; a second positioning portion 77, which is positioned so that its axial line coincides with that of the photoconductive drum 51, and which projects outward from the second end cover 45 of the cartridge 7 in the lengthwise direction of the photoconductive drum 51, and is fixed in position by the second positioning portion 34 of the apparatus main assembly 25 as the cartridge 7 is mounted into the apparatus main assembly 25; a third positioning portion 78, which is disposed on the downstream side with respect to the first positioning portion 76 in terms of the direction in which the cartridge 7 is mounted into the apparatus main assembly 25, and which projects outward from the first end cover 44 of the cartridge 7 in the lengthwise direction of the photoconductive drum 51, and is fixed in position by the third positioning portion 35 of the apparatus main assembly 25 as the cartridge 7 is mounted into the apparatus main assembly 25; and a driving force receiving portion 69, which is disposed between the first positioning portion 76 and third positioning portion 76 in terms of the cartridge mounting direction, being partially exposed from the first end cover 44, and which engages with the driving force transmitting portion 69*c* of the apparatus main assembly 25, from the upstream side in terms of the cartridge mounting direction, as the cartridge 7 is mounted into the apparatus main assembly 25, and receives from the driving force transmitting portion 69*c* of the apparatus main assembly 25, the driving force for driving the developing member 54.

According to another characteristic aspect of the above embodiment of a process cartridge in accordance with the present invention, the driving force receiving portion 69 is a helical gear. The third positioning portion 78 of the cartridge 7, in the form of a cylinder, is disposed out of the path which the driving force receiving portion 69 follows to be engaged with the driving force transmitting portion 69*c* of the apparatus main assembly 25 as the cartridge 7 is mounted into the apparatus main assembly 25. Further, the third positioning portion 78 of the cartridge 7, in the form of a cylinder, is disposed below the level of the path which the driving force receiving portion 69 follows to be engaged with the driving force transmitting portion 69*c* of the apparatus main assembly 25 as the cartridge 7 is mounted into the apparatus main assembly 25.

According to another characteristic aspect of the above embodiment of a process cartridge in accordance with the present invention, the first and second positioning portions 76 and 77 of the cartridge 7 are the bearings 66 and 67 for rotationally supporting the drum shaft 51A of the photoconductive drum 51.

According to another characteristic aspect of the above embodiment of a process cartridge in accordance with the present invention, the cylindrical portion, as the third positioning portion 78, of the cartridge 7 is an integral part of the first end cover 44 formed by molding.

According to another characteristic aspect of the above embodiment of a process cartridge in accordance with the present invention, the helical gear as the driving force receiving portion 69, the cylindrical portion as the third positioning portion 78, and the bearing 66 as the first positioning portion 76 for rotationally supporting the drum shaft 51A of the photoconductive drum 51, are disposed in the mentioned order, listing from the inward-to-outward direction, in terms of the lengthwise direction of the photoconductive drum 51.

According to another characteristic aspect of the above embodiment of a process cartridge in accordance with the present invention, the process cartridge 7 comprises the third guide 79, which is disposed on the downstream side with respect to the second positioning portion 77 in terms of the direction in which the cartridge 7 is mounted into the apparatus main assembly 25, and which projects outward from the second end cover 45 of the cartridge 7 in the lengthwise direction of the photoconductive drum 51, and is guided by the third guide 36 of the apparatus main assembly 25 when the cartridge 7 is mounted into the apparatus main assembly 25. Further, the third guide 79 of the cartridge 7 is disposed on the top side with respect to the third positioning portion 78 of the cartridge 7 in terms of the vertical direction. Further, it is a cylindrical member, and is an integral part of the second end cover 45 formed by molding.

According to another characteristic aspect of the above embodiment of a process cartridge in accordance with the present invention, the cartridge 7 comprises the top and bottom units 41 and 42, wherein the top unit 41 comprises: the photoconductive drum 51; the charging member 52 for charging the photoconductive drum 51; and the cleaning member 56 for removing the developer remaining on the photoconductive drum 51; and the removed developer storing portion 55 for storing the developer removed by the cleaning member 56, and the bottom unit 42 comprises: the developing member 54; and the developer storing portion 59 for storing the developer used by the developing member for developing an electrostatic latent image; wherein the units 41 and 42 are connected to each other, with the interposition of the elastic members 63, in a manner to be pivotal relative to each other so that the developing member 54 is kept pressed upon the photoconductive drum 51 by the resiliency of the elastic members 63; and wherein the top unit 41 comprises the first end cover 44, the second end cover 45, the first guide 74, the second guide 76, the second positioning portion 77, and the third positioning portion 78, and the bottom unit 42 comprises the second guide 75.

According to another characteristic aspect of the above embodiment of a process cartridge in accordance with the present invention, the first and second positioning portions 76 and 77 of the cartridge 7 are kept pressured in the cartridge mounting direction by the resiliency of the elastic members (unshown) of the apparatus main assembly 25, or the top surface of the top unit 41 is kept pressured in the cartridge mounting direction by the resiliency of the elastic members (unshown) of the apparatus main assembly 25, while the cartridge 7 is in the proper position in the apparatus main assembly 25.

According to another characteristic aspect of the above embodiment of a process cartridge in accordance with the present invention, the cartridge 7 comprises the handles 65 projecting in the direction opposite to the cartridge mounting direction.

The above described embodiment of an electrophotographic image forming apparatus in accordance with the present invention, in the main assembly 25 of which the cartridge 7 is removably mountable, and which forms an image on recording medium, is characterized in that it comprises: (a) first and second guides 31 and 32; (b) first, second, and third positioning portions 33, 34, and 35; and (c) the cartridge mounting portion 30, in which the cartridge is removably mountable. The cartridge 7 comprises: the electrophotographic photoconductive drum 51; the developing member 54 for developing en electrostatic latent image formed on the photoconductive drum 51; the first end cover 44 disposed at one of the lengthwise ends of the photoconductive drum 51; the second end cover 45 disposed at the other lengthwise end of the photoconductive drum 51; the first guide 74 formed on the bottom surface of the cartridge 7 so that it is guided by the first guide 31 of the apparatus main assembly 25 when the cartridge 7 is mounted into the apparatus main assembly 25; the second guide 75 formed on the bottom surface of the cartridge 7 so that it is guided by the second guide 32 of the apparatus main assembly 25 when the cartridge 7 is mounted into the apparatus main assembly 25; the first positioning portion 76, which is positioned so that its axial line coincides with that of the photoconductive drum 51, and which projects outward of the cartridge 7 from the first end cover 44 in the lengthwise direction of the photoconductive drum 51, and is fixed in position by the first positioning portion 33 of the apparatus main assembly 25 as the cartridge 7 is mounted into the apparatus main assembly 25; the second positioning portion 77, which is positioned so that its axial line coincides with that of the photoconductive drum 51, and which projects outward of the cartridge 7 from the second end cover 45 in the lengthwise direction of the photoconductive drum 51, and is fixed in position by the second positioning portion 34 of the apparatus main assembly 25 as the cartridge 7 is mounted into the apparatus main assembly 25; the third positioning portion 78, which is disposed on the downstream side with respect to the first positioning portion 76 in terms of the direction in which the cartridge 7 is mounted into the apparatus main assembly 25, and which projects outward of the cartridge 7 from the first end cover 44 in the lengthwise direction of the photoconductive drum 51, and is fixed in position by the third positioning portion 35 of the apparatus main assembly 25 as the cartridge 7 is mounted into the apparatus main assembly 25; and the driving force receiving portion 69, which is disposed between the first positioning portion 76 and third positioning portion 76 in terms of the cartridge mounting direction, being partially exposed from the first end cover 44, and which engages with the driving force transmitting portion 69*c* of the apparatus main assembly 25, from the upstream side in terms of the cartridge mounting direction, as the cartridge 7 is mounted into the apparatus main assembly 25, and receives from the driving force transmitting portion 69*c* of the apparatus main assembly 25, the driving force for driving the developing member 54, is removably mountable.

According to another characteristic aspect of the above embodiment of an electrophotographic image forming apparatus in accordance with the present invention, the third positioning portion 35 of the apparatus main assembly 25 is disposed out of the path which the driving force receiving portion 69 follows to be engaged with the driving force transmitting portion 69*c* of the apparatus main assembly 25 when the cartridge 7 is mounted into the apparatus main assembly 25.

According to another characteristic aspect of the above embodiment of an electrophotographic image forming apparatus in accordance with the present invention, the point at which the development roller driving force is received falls within the triangular area bordered by the lines connecting the first, second, and third positioning points of the process cartridge 7, making it possible to keep the cartridge 7 stable in attitude even while the cartridge 7 is driven. In other words, the cartridge 7 can be positioned with a high degree of reliability and precision, with the provision of the above described structural arrangement which is simple. Therefore, the accuracy with which an image is formed is improved.

As described above, according to the present invention, a process cartridge can be kept stable in attitude even while the process cartridge is driven.

While the invention has been described with reference to the structures disclosed herein, it is not confined to the details set forth, and this application is intended to cover such modifications or changes as may come within the purposes of the improvements or the scope of the following claims.

What is claimed is:

1. A process cartridge detachably mountable to a main assembly of an electrophotographic image forming apparatus, comprising:

an electrophotographic photosensitive drum;

a developing member configured and positioned to develop an electrostatic latent image formed on said electrophotographic photosensitive drum;

a first end cover portion provided at one longitudinal end of said electrophotographic photosensitive drum;

a second end cover portion provided at the other longitudinal end of said electrophotographic photosensitive drum;

a first portion to be guided provided on a bottom surface of said process cartridge so as to be guided by a first main assembly guide portion provided in the main assembly of the electrophotographic image forming apparatus when said process cartridge is mounted to the main assembly of the electrophotographic image forming apparatus;

a second portion to be guided provided on a bottom surface of said process cartridge so as to be guided by a second main assembly guide portion provided in the main assembly of the electrophotographic image forming apparatus when said process cartridge is mounted to the main assembly of the electrophotographic image forming apparatus;

a first portion to be positioned which is coaxial with said electrophotographic photosensitive drum and which is provided to project longitudinally outwardly of said electrophotographic photosensitive drum from said first end cover portion, said first portion to be positioned being positioned by a first main assembly positioning portion provided in the main assembly of the electrophotographic image forming apparatus when said process cartridge is mounted to the main assembly of the electrophotographic image forming apparatus;

a second portion to be positioned which is coaxial with said electrophotographic photosensitive drum and which is provided to project longitudinally outwardly of said electrophotographic photosensitive drum from said second end cover portion, said second portion to be positioned being positioned by a second main assembly positioning portion provided in the main assembly of the electrophotographic image forming apparatus when said process cartridge is mounted to the main assembly of the electrophotographic image forming apparatus;

a third portion to be positioned provided to project parallel to the lengthwise direction of said process cartridge from said first end cover portion at a position downstream of said first portion to be positioned with respect to a mounting direction in which said process cartridge is mounted to the main assembly of the electrophotographic image forming apparatus, said third portion to be positioned being positioned by a third main assembly positioning portion provided in the main assembly of the electrophotographic image forming apparatus when said process cartridge is mounted to the main assembly of the electrophotographic image forming apparatus; and a driving force receiving portion provided to be partly exposed through said first end cover portion between said first portion to be positioned and said third portion to be positioned with respect to the mounting direction, said driving force receiving portion, when said process cartridge is mounted to the main assembly of the electrophotographic image forming apparatus, engaging in the mounting direction with a main assembly driving force transmitting portion provided in the main assembly of the electrophotographic image forming apparatus to receive a driving force for rotating said developing member from the main assembly driving force transmitting portion.

2. A process cartridge according to claim 1, wherein said third portion to be positioned is disposed at a position out of a movement path along which said driving force receiving portion moves to engage with the main assembly driving force transmitting portion.

3. A process cartridge according to claim 1 or 2, wherein said third portion to be positioned is in the form of a circular column and is disposed below a movement path along which said driving force receiving portion moves to engage with the main assembly driving force transmitting portion.

4. A process cartridge according to claim 3, wherein said third portion to be positioned is molded integrally with said first end cover portion.

5. A process cartridge according to claim 1 or 2, wherein said first portion to be positioned and said second portion to be positioned include bearings configured and positioned to rotatably support a drum shaft of said electrophotographic photosensitive drum.

6. A process cartridge according to claim 1 or 2, wherein a helical gear of said driving force receiving portion, a circular column of said third portion to be positioned, and a bearing of said first portion to be positioned configured and positioned to support a drum shaft of said electrophotographic photosensitive drum, are positioned in the order named in a longitudinal direction of said electrophotographic photosensitive drum from the inside to the outside thereof.

7. A process cartridge according to claim 1, further comprising a third portion to be guided provided to project longitudinally outwardly of said electrophotographic photosensitive drum from said second end cover portion at a position downstream of said second portion to be positioned with respect to the mounting direction, said third portion to be guided being guided by a third main assembly guide portion provided in the main assembly of the electrophotographic image forming apparatus when said process cartridge is mounted to the main assembly of the electrophotographic image forming apparatus.

8. A process cartridge according to claim 7, wherein said third portion to be guided is disposed above said third portion to be positioned in a vertical direction when said process cartridge is mounted to the main assembly of the electrophotographic image forming apparatus.

9. A process cartridge according to claim 1 or 8, wherein said process cartridge further includes:

a first unit containing said electrophotographic photosensitive drum, a charging member configured and positioned to electrically charge said electrophotographic photosensitive drum, a cleaning member configured and positioned to remove a residual developer remaining on said electrophotographic photosensitive drum and a removed developer accommodating portion configured and positioned to accommodate the developer removed from said cleaning member; and a second unit containing said developing member and a developer accommodating portion configured and positioned to accommodate the developer to be used by said developing member to develop the electrostatic latent image, wherein said first and second units are rotatably coupled with each other such that said developing member is urged to said electrophotographic photosensitive drum by an elastic force of a first elastic member, wherein said first end cover portion, said second end cover portion, said first portion to be guided, said first portion to be positioned, said second portion to be positioned and said third portion to be positioned are provided in said first unit, and wherein said second portion to be guided is provided in said second unit.

10. A process cartridge according to claim 9, wherein when said process cartridge is set in the main assembly of the electrophotographic image forming apparatus, an upper surface of said first unit is urged in the mounting direction by an elastic force of a second elastic member, which is provided in the main assembly of the electrophotographic image forming apparatus.

11. A process cartridge according to claim 1 or 8, wherein said first portion to be positioned and second portion to be positioned are urged in the mounting direction by an elastic force of an elastic member provided in the main assembly of the electrophotographic image forming apparatus.

12. A process cartridge according to claim 7 or 8, wherein said third portion to be guided is in the form of a circular column and is integrally molded with said second end cover portion.

13. A process cartridge according to claim 1, further comprising a grip portion projected in the direction opposite the mounting direction.

14. An electrophotographic image forming apparatus for forming an image on a recording material, and having a main assembly to which a process cartridge is detachably mountable, said apparatus comprising:

(a) a first main assembly guide portion and a second main assembly guide portion;

(b) a first main assembly positioning portion, a second main assembly positioning portion and a third main assembly positioning portion; and (c) a mounting portion configured and positioned to detachably mount the process cartridge, the process cartridge including:

an electrophotographic photosensitive drum;

a developing member configured and positioned to develop an electrostatic latent image formed on the electrophotographic photosensitive drum;

a first end cover portion provided at one longitudinal end of the electrophotographic photosensitive drum;

a second end cover portion provided at the other longitudinal end of the electrophotographic photosensitive drum;

a first portion to be guided provided on a bottom surface of the process cartridge so as to be guided by said first main assembly guide portion provided in said main assembly of said electrophotographic image forming apparatus when the process cartridge is mounted to said main assembly of said electrophotographic image forming apparatus;

a second portion to be guided provided on a bottom surface of the process cartridge so as to be guided by said second main assembly guide portion provided in said main assembly of said electrophotographic image forming apparatus when the process cartridge is mounted to said main assembly of said electrophotographic image forming apparatus;

a first portion to be positioned which is coaxial with the electrophotographic photosensitive drum and which is provided to project longitudinally outwardly of the electrophotographic photosensitive drum from the first end cover portion, the first portion to be positioned being positioned by said first main assembly positioning portion provided in said main assembly of said electrophotographic image forming apparatus when the process cartridge is mounted to said main assembly of said electrophotographic image forming apparatus;

a second portion to be positioned which is coaxial with the electrophotographic photosensitive drum and which is provided to project longitudinally outwardly of the electrophotographic photosensitive drum from the second end cover portion, the second portion to be positioned being positioned by said second main assembly positioning portion provided in said main assembly of said electrophotographic image forming apparatus when the process cartridge is mounted to said main assembly of said electrophotographic image forming apparatus;

a third portion to be positioned provided to project parallel to the lengthwise direction of the process cartridge from the first end cover portion at a position downstream of the first portion to be positioned with respect to a mounting direction in which the process cartridge is mounted to said main assembly of said electrophotographic image forming apparatus, the third portion to be positioned being positioned by said third main assembly positioning portion provided in said main assembly of said electrophotographic image forming apparatus when the process cartridge is mounted to said main assembly of said electrophotographic image forming apparatus; and a driving force receiving portion provided to be partly exposed through the first end cover portion between the first portion to be positioned and the third portion to be positioned with respect to the mounting direction, the driving force receiving portion, when the process cartridge is mounted to said main assembly of said electrophotographic image forming apparatus, engaging in the mounting direction with a main assembly driving force transmitting portion provided in said main assembly of said electrophotographic image forming apparatus to receive a driving force for rotating the developing member from said main assembly driving force transmitting portion.

15. A process cartridge according to claim 14, wherein the driving force receiving portion includes a helical gear, and the third portion to be positioned is in the form of a circular column and is disposed at a position out of a movement path along which the driving force receiving portion moves to engage with the main assembly driving force transmitting portion.

16. A process cartridge detachably mountable to a main assembly of an electrophotographic image forming apparatus, comprising:

an electrophotographic photosensitive drum;

a developing member configured and positioned to develop an electrostatic latent image formed on said electrophotographic photosensitive drum;

a first end cover portion provided at one longitudinal end of said electrophotographic photosensitive drum;

a second end cover portion provided at the other longitudinal end of said electrophotographic photosensitive drum;

a first portion to be guided provided on a bottom surface of said process cartridge so as to be guided by a first main assembly guide portion provided in the main assembly of the electrophotographic image forming apparatus when said process cartridge is mounted to the main assembly of the electrophotographic image forming apparatus;

a second portion to be guided provided on a bottom surface of said process cartridge so as to be guided by a second main assembly guide portion provided in the main assembly of the electrophotographic image forming apparatus when said process cartridge is mounted to the main assembly of the electrophotographic image forming apparatus;

a first portion to be positioned which is coaxial with said electrophotographic photosensitive drum and which is provided to project longitudinally outwardly of said electrophotographic photosensitive drum from said first end cover portion, said first portion to be positioned being positioned by a first main assembly positioning portion provided in the main assembly of the electrophotographic image forming apparatus when said process cartridge is mounted to the main assembly of the electrophotographic image forming apparatus;

a second portion to be positioned which is coaxial with said electrophotographic photosensitive drum and which is provided to project longitudinally outwardly of said electrophotographic photosensitive drum from said second end cover portion, said second portion to be positioned being positioned by a second main assembly positioning portion provided in the main assembly of the electrophotographic image forming apparatus when said process cartridge is mounted to the main assembly of the electrophotographic image forming apparatus;

a third portion to be positioned provided to project parallel to the lengthwise direction of said process cartridge from said first end cover portion at a position downstream of said first portion to be positioned with respect to a mounting direction in which said process cartridge is mounted to the main assembly of the electrophotographic image forming apparatus, said third portion to be positioned being positioned by a third main assembly positioning portion provided in the main assembly of the electrophotographic image forming apparatus when said process cartridge is mounted to the main assembly of the electrophotographic image forming apparatus; and a driving force receiving portion provided to be partly exposed through said first end cover portion between said first portion to be positioned and said third portion to be positioned with respect to the mounting direction, said driving force receiving portion, when said process cartridge is mounted to the main assembly of the electrophotographic image forming apparatus, engaging in the mounting direction with a main assembly driving force transmitting portion provided in the main assembly of the electrophotographic image forming apparatus to receive a driving force for rotating said developing member from the main assembly driving force transmitting portion, wherein said driving force receiving portion includes a helical gear, and said third portion to be positioned is in the form of a circular column and is disposed at a position out of a movement path along which said driving force receiving portion moves to engage with the main assembly driving force transmitting portion, wherein said third portion to be positioned is also disposed below the movement path along which said driving force receiving portion moves to engage with the main assembly driving force transmitting portion, and wherein said first portion to be positioned and said second portion to be positioned include bearings configured and positioned to rotatably support a drum shaft of said electrophotographic photosensitive drum.

17. A process cartridge according to claim 16, wherein said helical gear of said driving force receiving portion, said third portion to be positioned in the form of a circular column, and one of said bearings configured and positioned to rotatably support a drum shaft of said electrophotographic photosensitive drum, are provided in the order named in a longitudinal direction of said electrophotographic photosensitive drum from an inside to outside of thereof.

18. A process cartridge according to claim 16 or 17, further comprising a third portion to be guided provided to project longitudinally outwardly of said electrophotographic photosensitive drum from said second end cover portion at a position downstream of said second portion to be positioned with respect to the mounting direction, said third portion to be guided being guided by a third main assembly guiding portion provided in the main assembly of the electrophotographic image forming apparatus when said process cartridge is mounted to the main assembly of the electrophotographic image forming apparatus.

19. A process cartridge according to claim 18, wherein said process cartridge further includes:

a first unit containing said electrophotographic photosensitive drum, a charging member configured and positioned to electrically charge said electrophotographic photosensitive drum, a cleaning member configured and positioned to remove a residual developer remaining on said electrophotographic photosensitive drum and a removed developer accommodating portion configured and positioned to accommodate the developer removed from said cleaning member; and a second unit containing said developing member and a developer accommodating portion configured and positioned to accommodate the developer to be used by said developing member to develop the electrostatic latent image, wherein said first and second units are rotatably coupled with each other such that said developing member is urged to said electrophotographic photosensitive drum by an elastic force of a first elastic member, wherein said first end cover portion, said second end cover portion, said first portion to be guided, said first portion to be positioned, said second portion to be positioned and said third portion to be positioned are provided in said first unit, and wherein said second portion to be guided is provided in said second unit.

20. A process cartridge according to claim 19, wherein said first portion to be positioned and second portion to be positioned are urged in the mounting direction by the elastic force of a second elastic member provided in the main assembly of the electrophotographic image forming apparatus.

21. A process cartridge according to claim 20, wherein when said process cartridge is set in the main assembly of the electrophotographic image forming apparatus, an upper surface of said first unit is urged in the mounting direction by the elastic force of the second elastic member provided in the main assembly of the electrophotographic image forming apparatus.

22. An electrophotographic image forming apparatus for forming an image on a recording material, and having a main assembly to which a process cartridge is detachably mountable apparatus, said apparatus comprising:

(a) a first main assembly guide portion and a second main assembly guide portion;

(b) a first main assembly positioning portion, a second main assembly positioning portion, and a third main assembly positioning portion; and (c) a mounting portion configured and positioned to detachably mount the process cartridge, the process cartridge including:

an electrophotographic photosensitive drum;

a developing member for developing an electrostatic latent image formed on the electrophotographic photosensitive drum;

a first end cover portion provided at one longitudinal end of the electrophotographic photosensitive drum;

a second end cover portion provided at the other longitudinal end of the electrophotographic photosensitive drum;

a first portion to be guided provided on a bottom surface of the process cartridge so as to be guided by said first main assembly guide portion provided in said main assembly of said electrophotographic image forming apparatus when the process cartridge is mounted to said main assembly of said electrophotographic image forming apparatus;

a second portion to be guided provided on a bottom surface of the process cartridge so as to be guided by said second main assembly guide portion provided in said main assembly of said electrophotographic image forming apparatus when the process cartridge is mounted to said main assembly of said electrophotographic image forming apparatus;

a first portion to be positioned which is coaxial with the electrophotographic photosensitive drum and which is provided to project longitudinally outwardly of the electrophotographic photosensitive drum from the first end cover portion, the first portion to be positioned being positioned by said first main assembly positioning portion provided in said main assembly of said electrophotographic image forming apparatus when the process cartridge is mounted to said main assembly of said electrophotographic image forming apparatus;

a second portion to be positioned which is coaxial with the electrophotographic photosensitive drum and which is provided to project longitudinally outwardly of the electrophotographic photosensitive drum from the second end cover portion, the second portion to be positioned being positioned by said second main assembly positioning portion provided in said main assembly of said electrophotographic image forming apparatus when the process cartridge is mounted to said main assembly of said electrophotographic image forming apparatus;

a third portion to be positioned provided to project parallel to the lengthwise direction of the process cartridge from the first end cover portion at a position downstream of the first portion to be positioned with respect to a mounting direction in which the process cartridge is mounted to said main assembly of said electrophotographic image forming apparatus, the third portion to be positioned being positioned by said third main assembly positioning portion provided in said main assembly of said electrophotographic image forming apparatus when the process cartridge is mounted to said main assembly of said electrophotographic image forming apparatus; and a driving force receiving portion provided to be partly exposed through the first end cover portion between the first portion to be positioned and the third portion to be positioned with respect to the mounting direction, the driving force receiving portion, when the process cartridge is mounted to said main assembly of said electrophotographic image forming apparatus, engaging in the mounting direction with a main assembly driving force transmitting portion provided in said main assembly of said electrophotographic image forming apparatus to receive a driving force for rotating the developing member from the main assembly driving force transmitting portion, wherein the driving force receiving portion includes a helical gear, and the third portion to be positioned is in the form of a circular column and is disposed at a position out of a movement path along which the driving force receiving portion moves to engage with the main assembly driving force transmitting portion, wherein the third portion to be positioned is also disposed below the movement path along which the driving force receiving portion moves to engage with the main assembly driving force transmitting portion, and wherein the first portion to be positioned and the second portion to be positioned include bearings configured and positioned to rotatably support a drum shaft of the electrophotographic photosensitive drum.

23. A process cartridge detachably mountable to a main assembly of an electrophotographic image forming apparatus, comprising:

an electrophotographic photosensitive drum;

a developing member configured and positioned to develop an electrostatic latent image formed on said electrophotographic photosensitive drum;

an end cover portion provided at one longitudinal end of said electrophotographic photosensitive drum;

a first cartridge portion to be positioned which is coaxial with said electrophotographic photosensitive drum and which is provided to project longitudinally outwardly of said electrophotographic photosensitive drum from said end cover portion, said first cartridge portion to be positioned being positioned by a first positioning portion provided in the main assembly of the electrophotographic image forming apparatus when said process cartridge is mounted to the main assembly of the electrophotographic image forming apparatus;

a second cartridge portion to be positioned provided to project parallel to the lengthwise direction of said process cartridge from said end cover portion at a position downstream of said first cartridge portion to be positioned with respect to a mounting direction in which said process cartridge is mounted to the main assembly of the electrophotographic image forming apparatus, said second cartridge portion to be positioned being positioned by a second positioning portion provided in the main assembly of the electrophotographic image forming apparatus when said process cartridge is mounted to the main assembly of the electrophotographic image forming apparatus; and a driving force receiving portion provided to be partly exposed through said end cover portion between said first cartridge portion to be positioned and said second cartridge portion to be positioned with respect to the mounting direction, said driving force receiving portion, when said process cartridge is mounted to the main assembly of the electrophotographic image forming apparatus, engaging in the mounting direction with a main assembly driving force transmitting portion provided in the main assembly of the electrophotographic image forming apparatus to receive a driving force for rotating said developing member from the main assembly driving force transmitting portion, wherein said driving force receiving portion has an axis which is different from an axis of said electrophotographic photosensitive drum.

24. A process cartridge according to claim 23, wherein said second cartridge portion to be positioned is disposed at a position out of a movement path along which said driving force receiving portion moves to engage with the main assembly driving force transmitting portion.

25. A process cartridge according to claim 23 or 24, wherein said driving force receiving portion comprises a helical gear, wherein said second cartridge portion to be positioned comprises a circular column, wherein said first cartridge portion to be positioned comprises a bearing that is configured and positioned to rotatably support a drum shaft of said electrophotographic photosensitive drum, and wherein said helical gear, said circular column, and said bearing are positioned in this order in a longitudinal direction of said electrophotographic photosensitive drum from the inside to the outside thereof.

26. An electrophotographic image forming apparatus for forming an image on a recording material, and having a main assembly to which a process cartridge is detachably mountable, said apparatus comprising:

(a) a first positioning portion provided in said main assembly and a second positioning portion provided in said main assembly; and (b) a mounting portion configured and positioned to detachably mount the process cartridge, the process cartridge including:

an electrophotographic photosensitive drum;

a developing member configured and positioned to develop an electrostatic latent image formed on the electrophotographic photosensitive drum;

an end cover portion provided at one longitudinal end of the electrophotographic photosensitive drum;

a first cartridge portion to be positioned which is coaxial with the electrophotographic photosensitive drum and which is provided to project longitudinally outwardly of the electrophotographic photosensitive drum from the end cover portion, the first cartridge portion to be positioned being positioned by said first positioning portion when the process cartridge is mounted to said main assembly of said electrophotographic image forming apparatus;

a second cartridge portion to be positioned provided to project parallel to the lengthwise direction of the process cartridge of the electrophotographic photosensitive drum from the end cover portion at a position downstream of the first cartridge portion to be positioned with respect to a mounting direction in which the process cartridge is mounted to said main assembly of said electrophotographic image forming apparatus, the second cartridge portion to be positioned being positioned by said second positioning portion when the process cartridge is mounted to said main assembly of said electrophotographic image forming apparatus; and a driving force receiving portion provided to be partly exposed through the end cover portion between the first cartridge portion to be positioned and the second cartridge portion to be positioned with respect the mounting direction, the driving force receiving portion, when the process cartridge is mounted to said main assembly of said electrophotographic image forming apparatus, engaging in the mounting direction with a main assembly driving force transmitting portion provided in said main assembly of said electrophotographic image forming apparatus to receive a driving force for rotating the developing member from the main assembly driving force transmitting portion, wherein the driving force receiving portion has an axis which is different from an axis of the electrophotographic photosensitive drum.

27. A process cartridge detachably mountable to a main assembly of an electrophotographic image forming apparatus, comprising:

an electrophotographic photosensitive drum;

a developing member configured and positioned to develop an electrostatic latent image formed on said electrophotographic photosensitive drum;

a drum unit supporting said electrophotographic photosensitive drum;

a developing unit supporting said developing member;

a first portion to be positioned which is coaxial with said electrophotographic photosensitive drum and which is provided to project longitudinally outwardly of said electrophotographic photosensitive drum from said drum unit, said first portion to be positioned being positioned by a first main assembly positioning portion provided in the main assembly of the electrophotographic image forming apparatus when said process cartridge is mounted to the main assembly of the electrophotographic image forming apparatus, wherein said first portion to be positioned rotatably supports a drum shaft of said electrophotographic photosensitive drum;

a second portion to be positioned which is coaxial with said electrophotographic photosensitive drum and which is provided to project longitudinally outwardly of said electrophotographic photosensitive drum from said drum unit, said second portion to be positioned being positioned by a second main assembly positioning portion provided in the main assembly of the electrophotographic image forming apparatus when said process cartridge is mounted to the main assembly of the electrophotographic image forming apparatus, wherein said second portion to be positioned rotatably supports the drum shaft;

a third portion to be positioned provided to project parallel to the lengthwise direction of said process cartridge from said drum unit at a position downstream of said first portion to be positioned with respect to a mounting direction in which said process cartridge is mounted to the main assembly of the electrophotographic image forming apparatus, said third portion to be positioned being positioned by a third main assembly positioning portion provided in the main assembly of the electrophotographic image forming apparatus when said process cartridge is mounted to the main assembly of the electrophotographic image forming apparatus;

a cartridge coupling provided at one longitudinal end of the drum shaft, configured and positioned to receive a driving force for rotating said electrophotographic photosensitive drum from the main assembly when said process cartridge is mounted to the main assembly; and a helical gear provided to be partly exposed through said drum unit between said first portion to be positioned and said third portion to be positioned with respect to the mounting direction, said helical gear being disposed at one longitudinal end of said developing unit, and when said process cartridge is mounted to the main assembly of the electrophotographic image forming apparatus, said helical gear receives a driving force for rotating said developing member from a main assembly driving force transmitting portion provided in the main assembly of the electrophotographic image forming apparatus.

28. A process cartridge according to claim 27, wherein said third portion to be positioned is disposed at a position out of a movement path along which said helical gear moves to engage with the main assembly driving force transmitting portion.

29. A process cartridge according to claim 27 or 28, wherein said third portion to be positioned is in the form of a circular column and is disposed below a movement path along which said helical gear moves to engage with the main assembly driving force transmitting portion.

30. A process cartridge according to claim 29, wherein said third portion to be positioned is molded integrally with said drum unit.

31. A process cartridge according to claim 27 or 28, wherein said helical gear, a circular column of said third portion to be positioned, and a bearing of said first portion to be positioned configured and positioned to support the drum shaft, are positioned in the order named in a longitudinal direction of said electrophotographic photosensitive drum from the inside to the outside thereof.

32. A process cartridge according to claim 27, further comprising:

a first end cover portion provided at one longitudinal end of said electrophotographic photosensitive drum;

a second end cover portion provided at the other longitudinal end of said electrophotographic photosensitive drum;

a first portion to be guided provided on a bottom surface of said process cartridge so as to be guided by a first main assembly guide portion provided in the main assembly of the electrophotographic image forming apparatus when said process cartridge is mounted to the main assembly of the electrophotographic image forming apparatus;

a second portion to be guided provided on a bottom surface of said process cartridge so as to be guided by a second main assembly guide portion provided in the main assembly of the electrophotographic image forming apparatus when said process cartridge is mounted to the main assembly of the electrophotographic image forming apparatus; and a third portion to be guided provided to project longitudinally outwardly of said electrophotographic photosensitive drum from said drum unit at a position downstream of said second portion to be positioned with respect to the mounting direction, said third portion to be guided being guided by a third main assembly guide portion provided in the main assembly of the electrophotographic image forming apparatus when said process cartridge is mounted to the main assembly of the electrophotographic image forming apparatus.

33. A process cartridge according to claim 32, wherein said third portion to be guided is disposed above said third portion to be positioned in a vertical direction when said process cartridge is mounted to the main assembly of the electrophotographic image forming apparatus.

34. A process cartridge according to claim 32 or 33, wherein said third portion to be guided is in the form of a circular column and is integrally molded with said drum unit.

35. A process cartridge according to claim 33, wherein said drum unit contains said electrophotographic photosensitive drum, a charging member configured and positioned to electrically charge said electrophotographic photosensitive drum, a cleaning member configured and positioned to remove a residual developer remaining on said electrophotographic photosensitive drum, and a removed developer accommodating portion configured and positioned to accommodate the developer removed from said cleaning member, and wherein said developing unit contains said developing member and a developer accommodating portion configured and positioned to accommodate the developer to be used by said developing member to develop the electrostatic latent image, wherein said drum and developing units are rotatably coupled with each other such that said developing member is urged to said electrophotographic photosensitive drum by an elastic force of a first elastic member, wherein said first portion to be guided, said first portion to be positioned, said second portion to be positioned, and said third portion to be positioned are provided in said drum unit, and wherein said second portion to be guided is provided in said developing unit.

36. A process cartridge according to claim 35, wherein when said process cartridge is set in the main assembly of the electrophotographic image forming apparatus, an upper surface of said drum unit is urged in the mounting direction by an elastic force of a second elastic member, which is provided in the main assembly of the electrophotographic image forming apparatus.

37. A process cartridge according to claim 27 or 33, wherein said first portion to be positioned and second portion to be positioned are urged in the mounting direction by an elastic force of an elastic member provided in the main assembly of the electrophotographic image forming apparatus.

38. A process cartridge according to claim 27, further comprising a grip portion projecting in the direction opposite from the mounting direction.

39. An electrophotographic image forming apparatus for forming an image on a recording material, and having a main assembly to which a process cartridge is detachably mountable, said apparatus comprising:

(a) a first main assembly positioning portion, a second main assembly positioning portion and a third main assembly positioning portion; and (b) a mounting portion configured and positioned to detachably mount the process cartridge, the process cartridge including an electrophotographic photosensitive drum, a developing member configured and positioned to develop an electrostatic latent image formed on the electrophotographic photosensitive drum, a drum unit supporting the electrophotographic photosensitive drum, a developing unit supporting the developing member, a first portion to be positioned which is coaxial with the electrophotographic photosensitive drum and which is provided to project longitudinally outwardly of the electrophotographic photosensitive drum from the drum unit, the first portion to be positioned being positioned by said first main assembly positioning portion provided in the main assembly of said electrophotographic image forming apparatus when the process cartridge is mounted to the main assembly of said electrophotographic image forming apparatus, wherein the first portion to be positioned rotatably supports a drum shaft of the electrophotographic photosensitive drum, a second portion to be positioned which is coaxial with the electrophotographic photosensitive drum and which is provided to project longitudinally outwardly of the electrophotographic photosensitive drum from the drum unit, the second portion to be positioned being positioned by said second main assembly positioning portion provided in the main assembly of said electrophotographic image forming apparatus when the process cartridge is mounted to the main assembly of said electrophotographic image forming apparatus, wherein the second portion to be positioned rotatably supports the drum shaft, a third portion to be positioned provided to project parallel to the lengthwise direction of the process cartridge from the drum unit at a position downstream of the first portion to be positioned with respect to a mounting direction in which the process cartridge is mounted to the main assembly of said electrophotographic image forming apparatus, the third portion to be positioned being positioned by said third main assembly positioning portion provided in the main assembly of said electrophotographic image forming apparatus when the process cartridge is mounted to the main electrophotographic image forming apparatus, a cartridge coupling provided at one longitudinal end of the drum shaft, configured and positioned to receive a driving force for rotating the electrophotographic photosensitive drum from the main assembly when the process cartridge is mounted to the main assembly, and a helical gear provided to be partly exposed through the drum unit between the first portion to be positioned and the third portion to be positioned with respect to the mounting direction, the helical gear being disposed at one longitudinal end of the developing unit, wherein the helical gear, when the process cartridge is mounted to the main assembly of said electrophotographic image forming apparatus, receives a driving force for rotating the developing member from a main assembly drive force transmitting portion provided in the main assembly of said electrophotographic image forming apparatus.

* * * * *

UNITED STATES PATENT AND TRADEMARK OFFICE

CERTIFICATE OF CORRECTION

PATENT NO. : 7,027,754 B2
APPLICATION NO. : 10/337891
DATED : April 11, 2006
INVENTOR(S) : Kinya Harada et al.

It is certified that error appears in the above-identified patent and that said Letters Patent is hereby corrected as shown below:

ON THE TITLE PAGE

At Item (56), U.S. Patent Documents, insert: --6,483,527 B2 11/2002 Kaneko et al. .... 347/188--, and --2001/0017994 A1 8/2001 Arimitsu et al. ... 399/111--.

At Item (56), Foreign Patent Documents, insert: --JP 2001-242671 A 9/2001--; --JP 10-104905 A 4/1998--; --JP 10-105022 A 4/1998--; --JP 10/186851 7/1998--; --JP 10-78736 3/1998--; --JP 2001-66968 3/2001--; --JP 7-325534 12/1995--; --JP 2001-166668 6/2001--.

Title page illustrating a Figure should be deleted, replace with new Title page illustration a Figure.

(12) United States Patent
Harada et al.

(10) Patent No.: US 7,027,754 B2
(45) Date of Patent: Apr. 11, 2006

(54) PROCESS CARTRIDGE AND ELECTROPHOTOGRAPHIC IMAGE FORMING APPARATUS

(75) Inventors: Kinya Harada, Susono (JP); Kouji Hashimoto, Shizuoka-ken (JP); Tachio Kawai, Odawara (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/337,891

(22) Filed: Jan. 8, 2003

(65) Prior Publication Data

US 2003/0142994 A1 Jul. 31, 2003

(30) Foreign Application Priority Data

Jan. 11, 2002 (JP) ..... 2002-004405

(51) Int. Cl.
*G03G 15/00* (2006.01)
*G03G 21/18* (2006.01)

(52) U.S. Cl. ..... 399/111; 399/113

(58) Field of Classification Search ..... 399/111, 399/113, 110, 75; 347/138, 152
See application file for complete search history.

(56) References Cited

U.S. PATENT DOCUMENTS

| | | | | |
|---|---|---|---|---|
| 5,740,500 | A | 4/1998 | Hashimoto | 399/114 |
| 5,878,309 | A | 3/1999 | Nomura et al. | 399/111 |
| 5,903,803 | A | 5/1999 | Kawai et al. | 399/116 |
| 5,907,751 | A * | 5/1999 | Kawaguchi et al. | 399/111 X |
| 5,923,924 | A | 7/1999 | Hashimoto | 399/111 |
| 5,940,657 | A | 8/1999 | Yokomori et al. | 399/119 |
| 5,943,528 | A | 8/1999 | Akutsu et al. | 399/110 |
| 5,946,531 | A | 8/1999 | Miura et al. | 399/111 |
| 5,950,049 | A | 9/1999 | Yokomori et al. | 399/119 |
| 5,953,562 | A | 9/1999 | Kawaguchi et al. | 399/117 |
| 6,016,408 | A | 1/2000 | Hashimoto et al. | 399/27 |
| 6,035,159 | A * | 3/2000 | Azuma et al. | 399/111 |
| 6,044,235 | A | 3/2000 | Hashimoto | 399/99 |
| 6,055,406 | A | 4/2000 | Kawai et al. | 399/360 |
| 6,061,538 | A | 5/2000 | Arimitsu et al. | 399/111 |
| 6,064,843 | A | 5/2000 | Isobe et al. | 399/111 |
| 6,072,969 | A | 6/2000 | Yokomori et al. | 399/110 |
| 6,101,352 | A | 8/2000 | Hashimoto et al. | 399/110 |
| 6,115,567 | A | 9/2000 | Kawai et al. | 399/106 |
| 6,128,452 | A | 10/2000 | Miyabe et al. | 399/90 |
| 6,128,454 | A | 10/2000 | Kawai et al. | 399/116 |
| 6,151,459 | A | 11/2000 | Hashimoto et al. | 399/27 |
| 6,163,665 | A | 12/2000 | Watanabe et al. | 399/111 |
| 6,175,706 | B1 | 1/2001 | Watanabe et al. | 399/167 |

(Continued)

FOREIGN PATENT DOCUMENTS

| | | | |
|---|---|---|---|
| EP | 833 227 A2 | | 4/1998 |
| JP | 06-194892 | * | 7/1994 |
| JP | 2000-056656 | * | 2/2000 |

*Primary Examiner*—Sophia S. Chen
(74) *Attorney, Agent, or Firm*—Fitzpatrick, Cella, Harper & Scinto

(57) ABSTRACT

A process cartridge detachably mountable to a main assembly of an electrophotographic image forming apparatus includes first and second end covers, first and second bottom-surface portions to be guided by first and second main assembly guide portions, first, second, and third portions to be positioned by first, second, and third main assembly positioning portions, and a driving force receiving portion partly exposed through the first end cover between the first and third portions to be positioned and engaging with a main assembly driving force transmitting portion to rotate a process-cartridge developing member when the process cartridge is mounted to the apparatus.

39 Claims, 8 Drawing Sheets

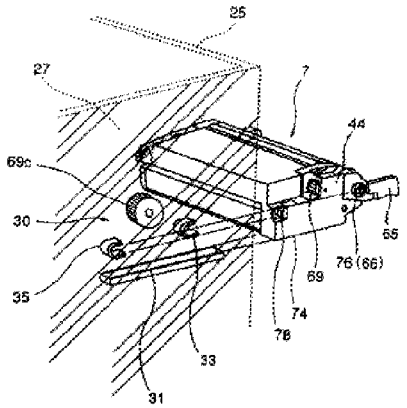

UNITED STATES PATENT AND TRADEMARK OFFICE

CERTIFICATE OF CORRECTION

PATENT NO. : 7,027,754 B2 
APPLICATION NO. : 10/337891
DATED : April 11, 2006
INVENTOR(S) : Kinya Harada et al.

It is certified that error appears in the above-identified patent and that said Letters Patent is hereby corrected as shown below:

FIGURE 5 ON SHEET 5 OF THE DRAWINGS

Figure 5 should be replaced with the following drawing:

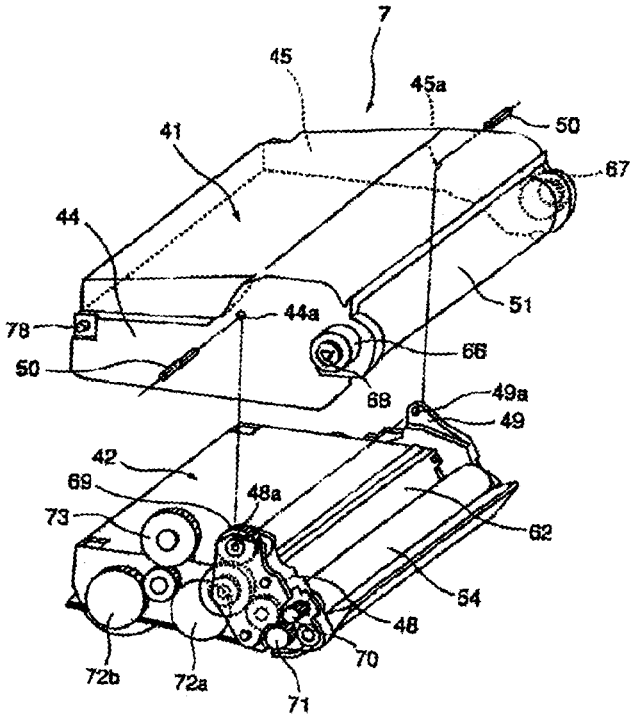

FIG. 5

UNITED STATES PATENT AND TRADEMARK OFFICE

CERTIFICATE OF CORRECTION

PATENT NO. : 7,027,754 B2 
APPLICATION NO. : 10/337891
DATED : April 11, 2006
INVENTOR(S) : Kinya Harada et al.

It is certified that error appears in the above-identified patent and that said Letters Patent is hereby corrected as shown below:

FIGURE 6 ON SHEET 6 OF THE DRAWINGS

Figure 6 should be replaced with the following drawing:

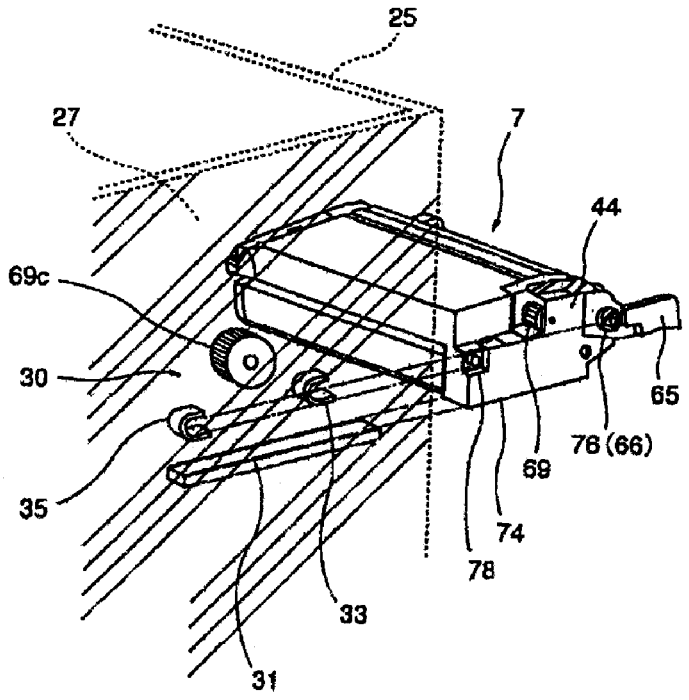

FIG. 6

UNITED STATES PATENT AND TRADEMARK OFFICE

CERTIFICATE OF CORRECTION

PATENT NO. : 7,027,754 B2 
APPLICATION NO. : 10/337891
DATED : April 11, 2006
INVENTOR(S) : Kinya Harada et al.

It is certified that error appears in the above-identified patent and that said Letters Patent is hereby corrected as shown below:

FIGURE 8 ON SHEET 8 OF THE DRAWINGS

Figure 8 should be replaced with the following drawing:

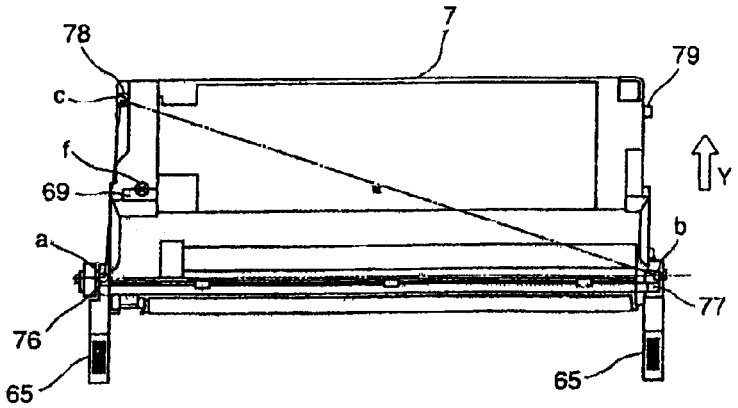

FIG. 8

COLUMN 2

Line 11, “above described” should read --above-described--.
Line 40, “above described” should read --above-described--.

COLUMN 3

Line 20, “assembly,” should read --assembly;--.
Line 51, “removable” should read --removably--.

COLUMN 10

Line 6, “belt 1,” should read --belt 11,--.
Line 35, “potions” should read --portions--.

UNITED STATES PATENT AND TRADEMARK OFFICE

CERTIFICATE OF CORRECTION

PATENT NO. : 7,027,754 B2
APPLICATION NO. : 10/337891
DATED : April 11, 2006
INVENTOR(S) : Kinya Harada et al.

It is certified that error appears in the above-identified patent and that said Letters Patent is hereby corrected as shown below:

COLUMN 12
Line 1, “unit,” should read --units,--.
Line 24, “drum.51” should read --drum 51--.

COLUMN 16
Line 10, “above described” should read --above-described--.
Line 22, “above” should read --above- --.
Line 24, “above described” should read --above-described--.
Line 38, “above described” should read --above-described--.

COLUMN 18
Line 49, “above described” should read --above-described--.

COLUMN 19
Line 56, “above” should read --above- --.

Signed and Sealed this

Tenth Day of February, 2009

JOHN DOLL
*Acting Director of the United States Patent and Trademark Office*